US006244766B1

(12) United States Patent
Dunn et al.

(10) Patent No.: US 6,244,766 B1
(45) Date of Patent: Jun. 12, 2001

(54) LABEL-PRINTING PROCESS FOR SUBSTANTIALLY LIGHT-INSENSITIVE ELONGATED MATERIALS INCLUDING AN ORGANIC SILVER SALT

(75) Inventors: Anthony Roy Dunn; Matthew Richard Palmer, both of Cambridge; Krystyna Maria Windle, Saffron Walden, all of (GB); Bartholomeus Horsten, Rumst (BE); David Tilemans, Lier (BE); Guy Jansen, Borsbeek (BE)

(73) Assignee: Agfa-Gevaert, Mortsel (BE)

( * ) Notice: Subject to any disclaimer, the term of this patent is extended or adjusted under 35 U.S.C. 154(b) by 0 days.

(21) Appl. No.: 09/452,061

(22) Filed: Nov. 30, 1999

Related U.S. Application Data

(60) Provisional application No. 60/118,817, filed on Feb. 5, 1999.

(30) Foreign Application Priority Data

Nov. 30, 1998 (EP) ..... 98204013

(51) Int. Cl.[7] ..... B41J 11/26

(52) U.S. Cl. ..... 400/615.2; 503/207

(58) Field of Search ..... 400/615.2; 503/207, 503/215–226, 200; 427/150–152; 430/162

(56) References Cited

U.S. PATENT DOCUMENTS

| | | | | |
|---|---|---|---|---|
| 4,370,370 | | 1/1983 | Iwata et al. | 428/40 |
| 5,216,438 | | 6/1993 | Nakao et al. | 346/76 |
| 5,411,929 | * | 5/1995 | Ford et al. | 503/210 |
| 5,489,567 | | 2/1996 | Koshizuka et al. | 503/227 |
| 5,525,571 | | 6/1996 | Hosoi | 503/200 |
| 5,633,670 | | 5/1997 | Kwak | 347/188 |
| 5,765,954 | | 6/1998 | Nunokawa et al. | 400/208 |
| 5,826,994 | | 10/1998 | Palmer | 400/615.2 |
| 6,028,029 | * | 2/2000 | Takeuchi | 503/207 |

FOREIGN PATENT DOCUMENTS

| | | |
|---|---|---|
| 0479578 | 4/1992 | (EP) . |
| 0622217 | 11/1994 | (EP) . |
| 0687572 | 12/1995 | (EP) . |
| 0736799 | 10/1996 | (EP) . |
| 0754564 | 1/1997 | (EP) . |
| 9816391 | 4/1998 | (WO) . |

* cited by examiner

*Primary Examiner*—John S. Hilten
*Assistant Examiner*—Charles H. Nolan, Jr.
(74) *Attorney, Agent, or Firm*—Baker Botts L.L.P.

(57) ABSTRACT

A label-printing process for obtaining a desired optical density and a desired color tone with a substantially light-insensitive elongated imaging material comprising:

selecting an elongated imaging material, the selected elongated imaging material having a support and a thermosensitive element;

supplying image data to a processing unit of a thermal printer including a printhead having energizable heating elements arranged in a column C;

converting the image data which are not zero into at least one activation pulse per pixel to be printed;

energizing the heating elements printing-line by printing-line adjacent to the selected substantially light-insensitive elongated imaging material thereby producing an image;

transporting the imaging material past and adjacent to the printhead in a transport direction with a transport system;

forming an image dot with a heat energy of 50 to 200 $mJ/mm^2$ of heating element surface area;

wherein the thermosensitive element contains a substantially light-insensitive organic silver salt, a reducing agent therefor in thermal working relationship therewith and a binder; and the thermosensitive element excludes a colorless or light colored dye precursor and also excludes an encapsulated organic silver salt in a heat-responsive microcapsule; and an apparatus therefor.

11 Claims, 10 Drawing Sheets

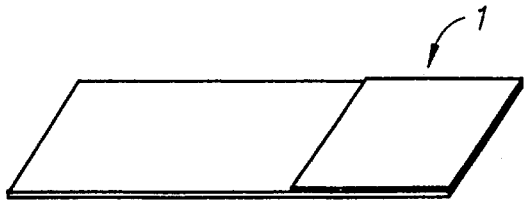
FIG. 1.1
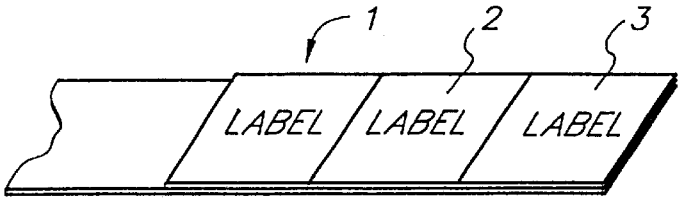
FIG. 1.2
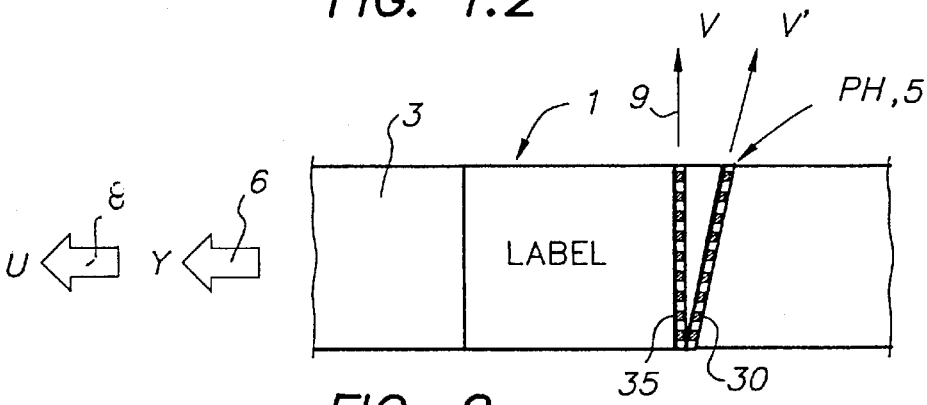
FIG. 2
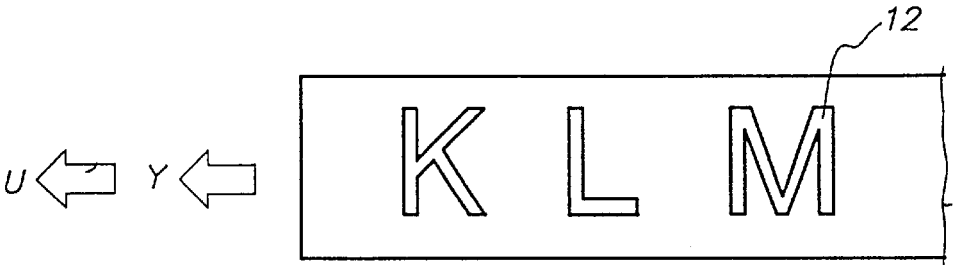
FIG. 3.1
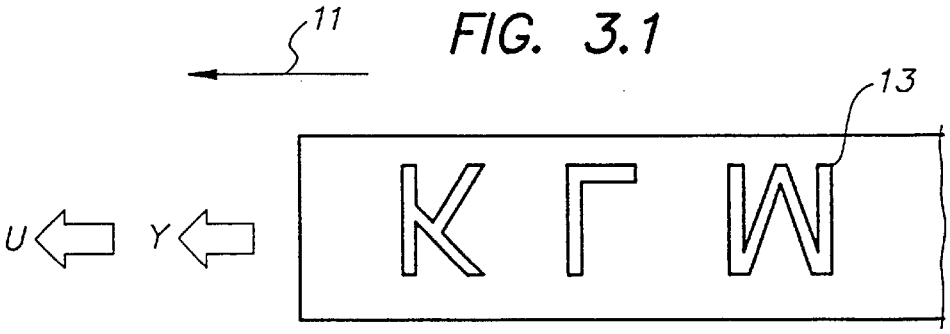
FIG. 3.2

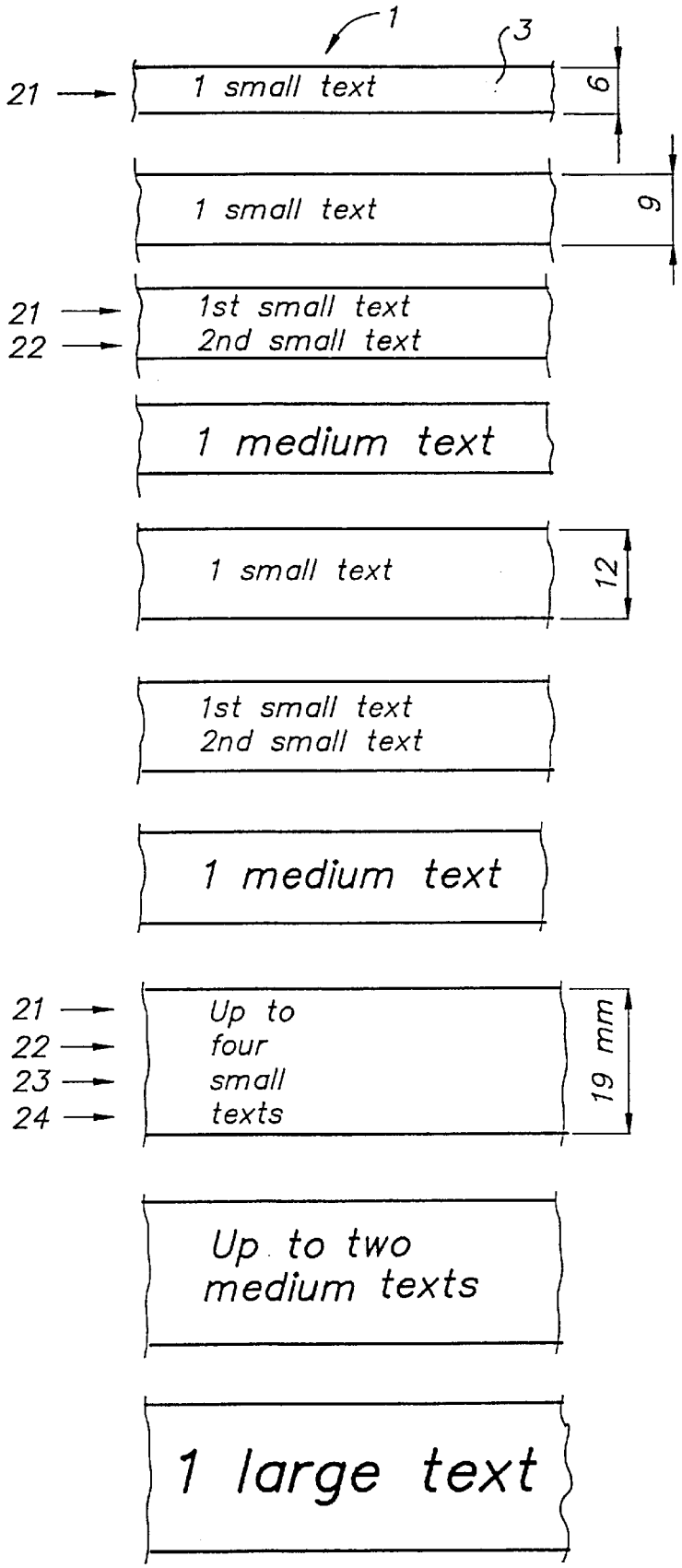
FIG. 4.1
FIG. 4.2
FIG. 4.3
FIG. 4.4
FIG. 4.5
FIG. 4.6
FIG. 4.7
FIG. 4.8
FIG. 4.9
FIG. 4.10

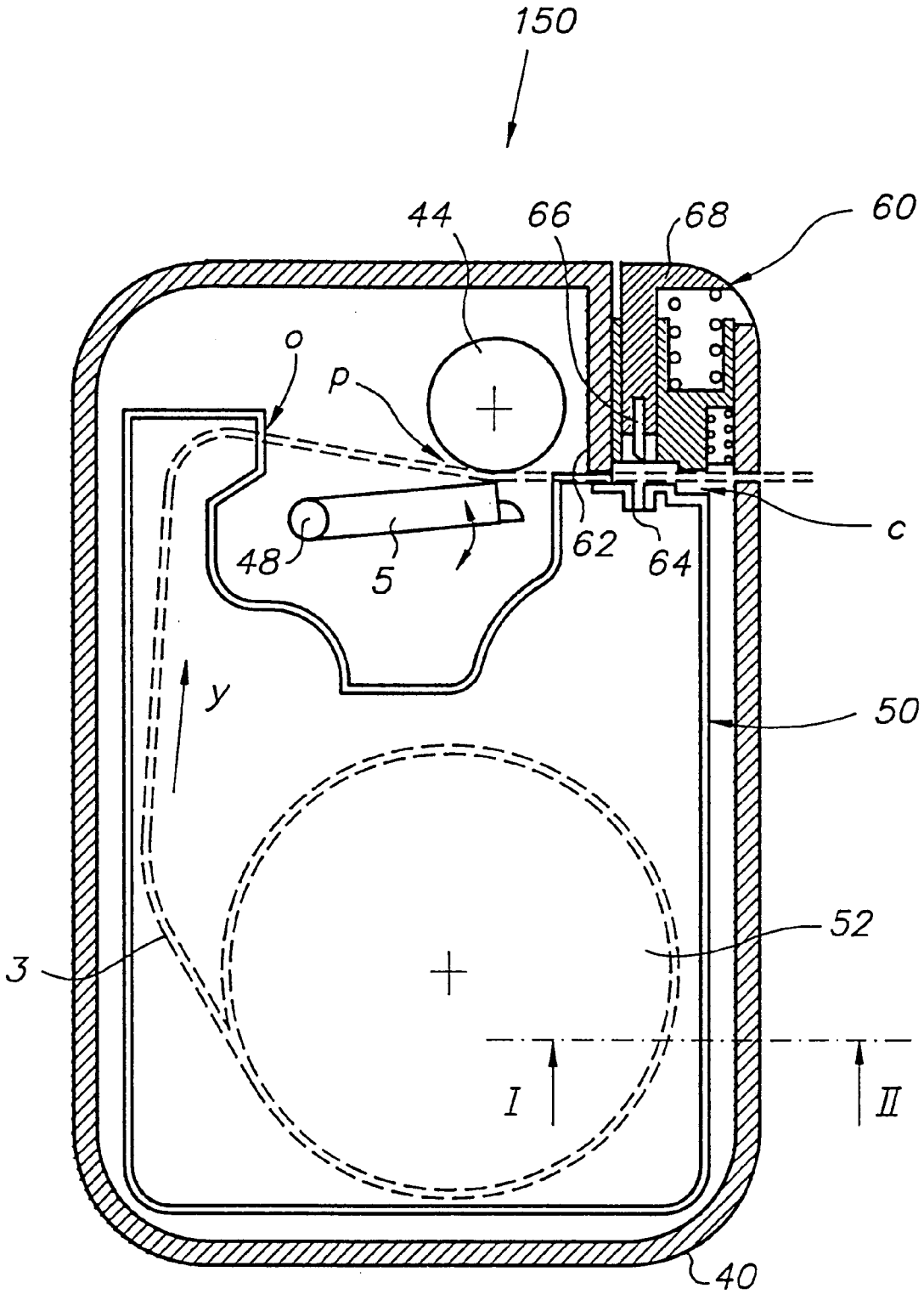
FIG. 5.0

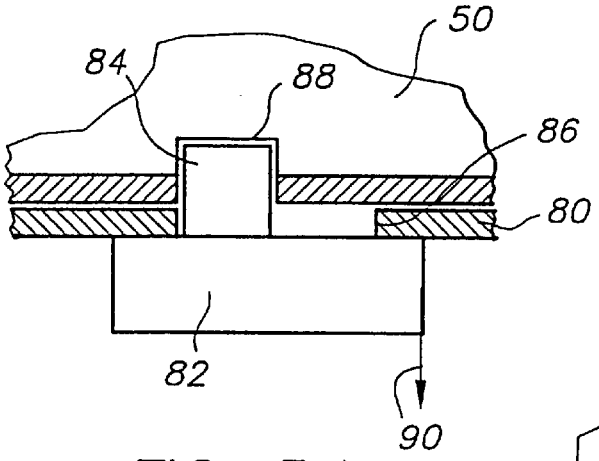
FIG. 5.1
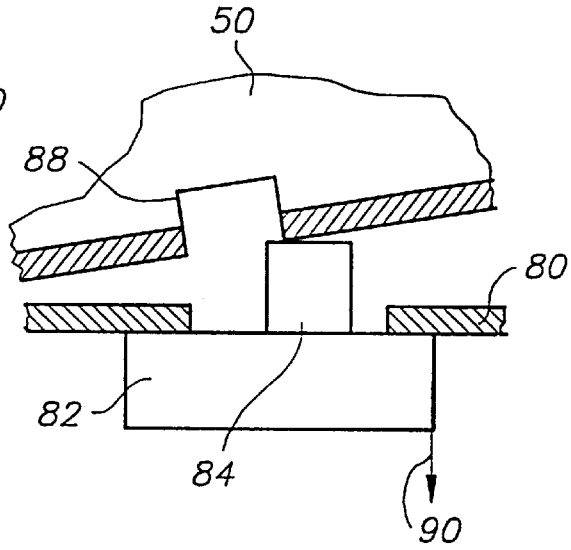
FIG. 5.2
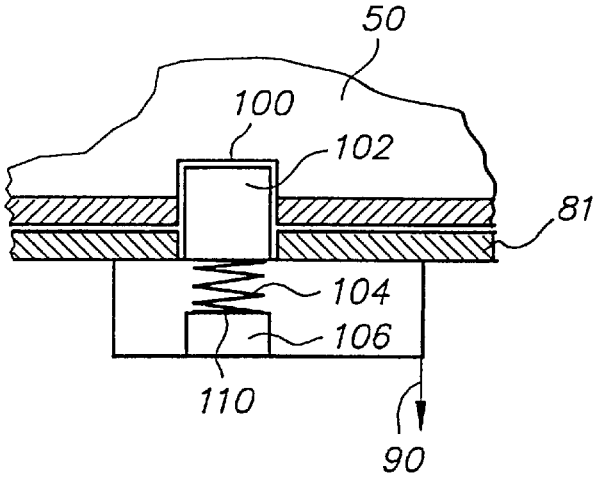
FIG. 5.3
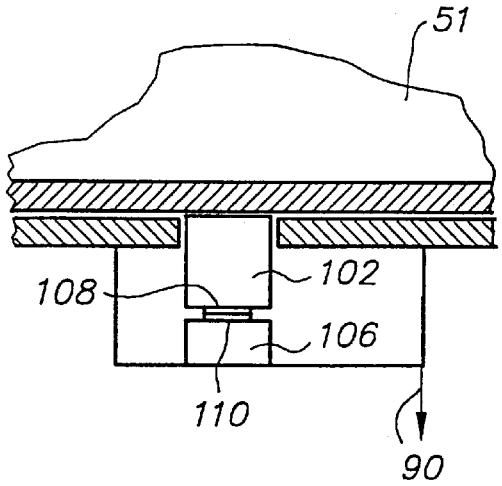
FIG. 5.4

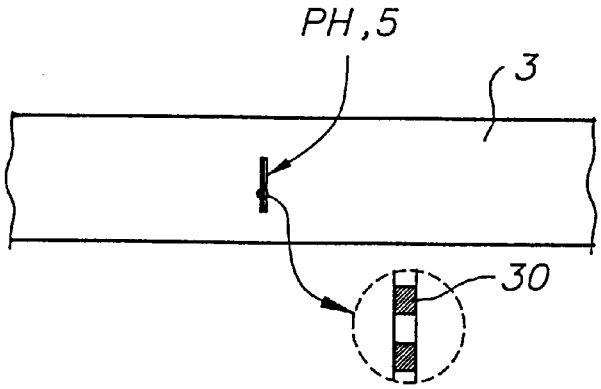
FIG. 9.1
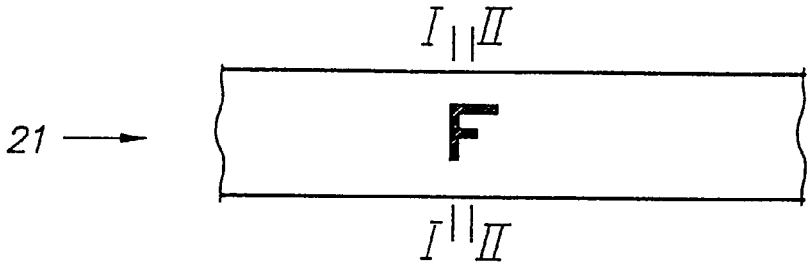
FIG. 9.2
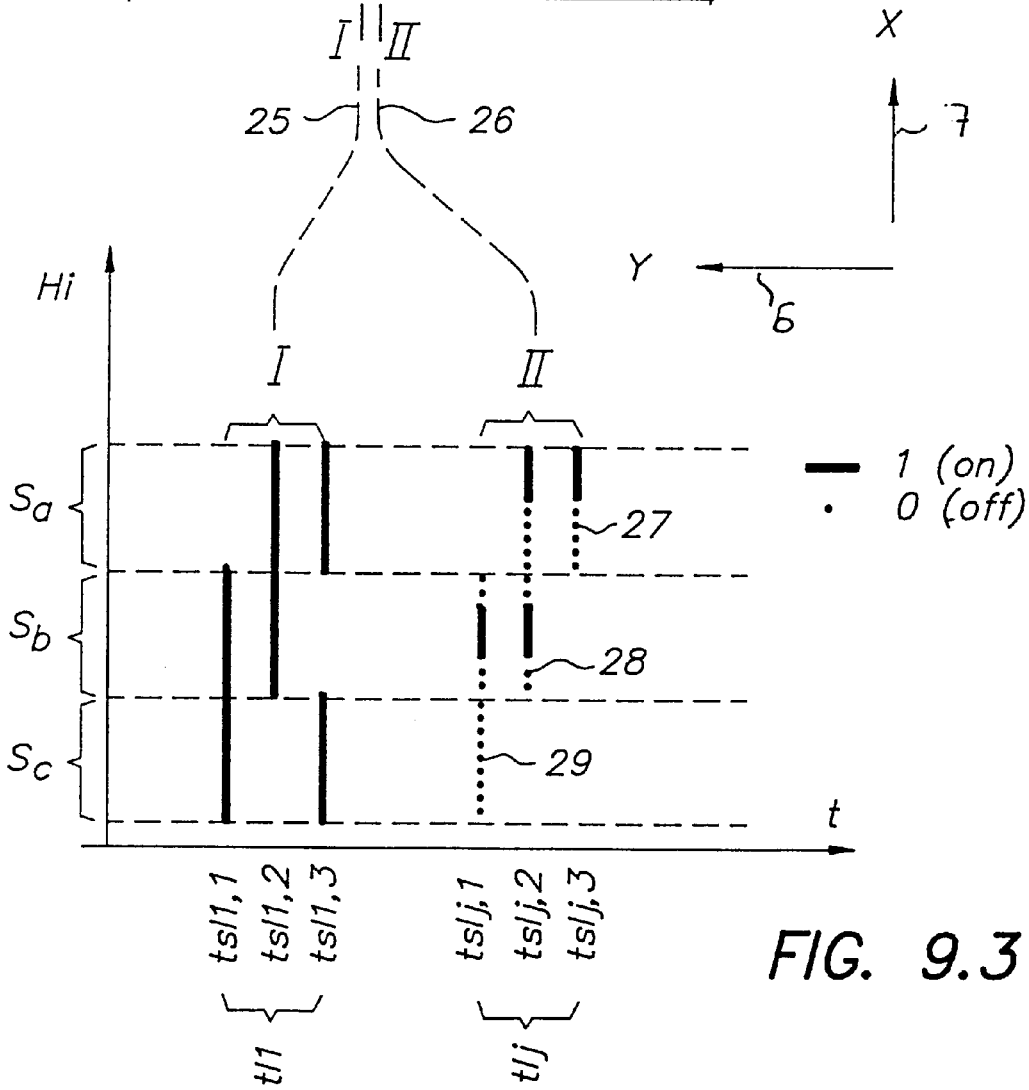
FIG. 9.3

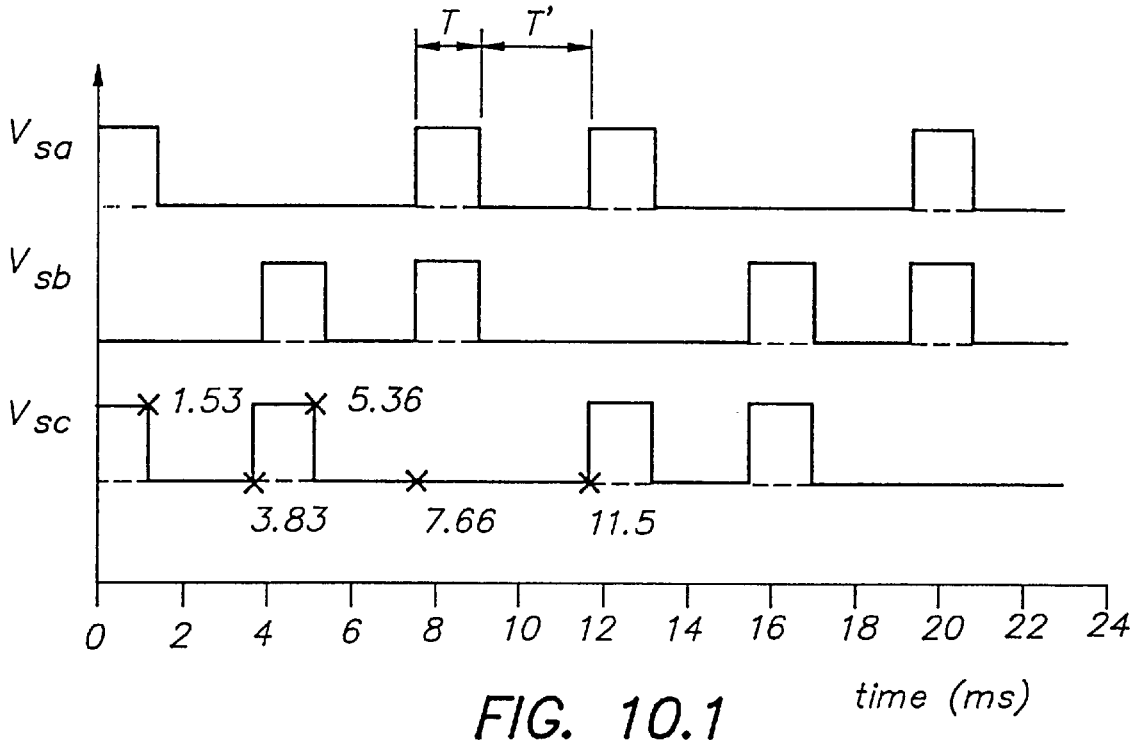
FIG. 10.1
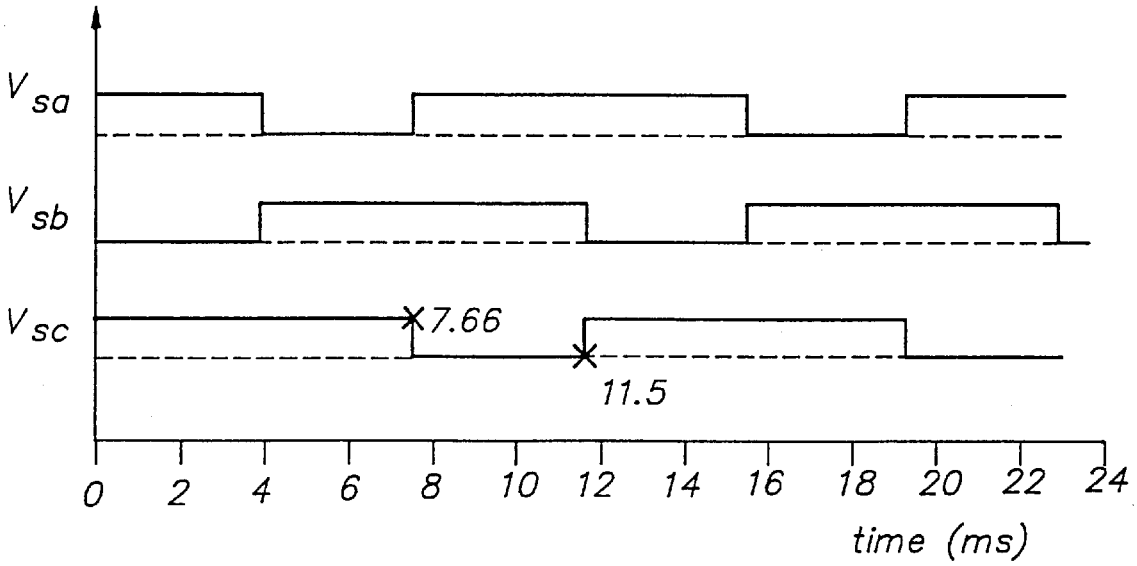
FIG. 10.2

LABEL-PRINTING PROCESS FOR SUBSTANTIALLY LIGHT-INSENSITIVE ELONGATED MATERIALS INCLUDING AN ORGANIC SILVER SALT

The application claims the benefit of the U.S. Provisional Application No. 60/118,817 filed Feb. 5, 1999.

DESCRIPTION

1. Field of the Invention

The present invention concerns a label-printing process using substantially light-insensitive elongated imaging materials.

2. Background of the Invention

Thermal imaging or thermography is a recording process wherein images are generated by the use of thermal energy. In direct thermal printing a visible image pattern is produced by image-wise heating of a recording material e.g. image signals can be converted into electric pulses and then via a driver circuit selectively transferred to a thermal printhead, which consists of microscopic heat resistor elements, thereby converting the electrical energy into heat via the Joule effect. This heat brings about image formation in the thermographic material.

Label-printing by means of thermography is known with tapes on the basis of monosheet materials such as colourless or light coloured dye precursor leuco-dye systems, as disclosed in U.S. Pat. No. 4,370,370, EP-A 479 578 and EP-A 754 564, diazo systems, as disclosed in JP 60-01077A, or two-sheet thermal dye transfer systems, such as disclosed in EP-A 656 264 and U.S. Pat. No. 4,943,555. EP-A 754 564 also discloses applied energy per unit area in different printing tests in the invention examples in the ranges of 20–140 mJ/mm$^2$, 80–140 mJ/mm$^2$, 30–50 mJ/mm$^2$, 80–100 mJ/mm$^2$, 30–35 mJ/mm$^2$ and 20–200 mJ/mm$^2$; as well as specific energies of 30 mJ/mm$^2$, 40 mJ/mm$^2$, 80 mJ/mm$^2$ and 90 mJ/mm$^2$.

EP 736 799A discloses a recording material comprising a support having provided thereon at least a recording layer comprising (a) a heat-responsive microcapsule having encapsulated therein an organic silver salt; (b) a developer for the organic silver salt and (c) a water-soluble binder. A heat recording energy per unit area of 60 mJ/mm$^2$ is disclosed in the invention examples.

Printing apparatuses for the production of labels using tape are disclosed in EP-A-322 918, EP-A-322 919 and EP-A-0267 890. These printers each include a printing device having a cassette bay for receiving a cassette or tape holding case. In EP-A-0267 890, the tape holding case houses an ink ribbon and a substrate tape, the latter comprising an upper imaging layer secured to a backing layer by adhesive. In EP-A-322 918 and EP-A-322 919, the tape holding case houses an ink ribbon, a transparent imaging tape and a double-sided adhesive tape which is secured at one of its adhesive coated sides to the image tape after printing and which has a backing layer peelable from its other adhesive coated side. With both these apparatus, the image transfer medium (ink ribbon) and an imaging tape (substrate) are in the same cassette.

EP 622 217 discloses a method for making an image by means of a direct thermal imaging element, comprising on a support a thermosensitive layer containing an organic silver salt and a reducing agent, the imaging element being imagewise heated by means of a thermal head having energizable heating elements, characterised in that the activation of the heating elements is executed line by line with a line-duty-cycle Δ representing the ratio of activation time to total line time, according to the equation $$P \leq P_{max} = 3.3\ \mathrm{W/mm^2} + (9.5\ \mathrm{W/mm^2} \times \Delta)$$

where $P_{max}$ is the maximal value over all heating elements of the time averaged power density P (expressed in W/mm$^2$) dissipated by a heating element during a line time.

Labels produced with monosheet direct thermal materials based on leuco-dyes have a well-known propensity to fade when exposed to light and thermal dye transfer systems are expensive to assemble and produce waste due to the disposal of the donor lint resulting in ecological objections.

OBJECTS OF THE INVENTION

It is therefore an object of the present invention to provide a label-printing process for producing labels from monosheet imaging tape which do not fade.

It is therefore a further object of the present invention to provide a label-printing process for printing labels from monosheet imaging tape which have excellent light stability and image tone.

Further objects and advantages of the invention will become apparent from the description hereinafter.

SUMMARY OF THE INVENTION

It has been surprisingly found that labels produced using monosheet substantially light-insensitive transparent imaging materials based on organic silver salts do not fade and have excellent light stability and image tone. It has also been surprisingly found that the image density is primarily dependent upon the heating energy used to produce a dot, for which the term "dot energy" will be used, regardless of how the heating power is supplied.

The above-mentioned objects are realised by a label-printing process for obtaining a desired optical density and a desired colour tone with a substantially light-insensitive elongated imaging material comprising:

- selecting an elongated imaging material, the selected elongated imaging material having a support and a thermosensitive element;
- supplying image data to a processing unit of a thermal printer including a printhead having energizable heating elements arranged in a column C;
- converting the image data which are not zero into at least one activation pulse per pixel to be printed;
- energising the heating elements printing-line by printing-line adjacent to the selected elongated imaging material thereby producing an image;
- transporting the selected thermographic sheet material past and adjacent to the printhead in a transport direction with a transport system;
- forming an image dot with a heat energy of 50 to 200 mJ/mm$^2$ of heating element surface area;

wherein the thermosensitive element contains a substantially light-insensitive organic silver salt, a reducing agent therefor in thermal working relationship therewith and a binder; and the thermosensitive element excludes a colourless or light coloured dye precursor and also excludes an encapsulated organic silver salt in a heat-responsive microcapsule.

An apparatus for the printing of labels is also provided according to the present invention comprising:

- a selector of a substantially light-insensitive elongated imaging material, the selected elongated imaging material having a support and a thermosensitive element;

a source of image data to a processing unit of a thermal printer including a printhead having energizable heating elements arranged in a column C;

a converter of the image data which are not zero into at least one activation pulse per pixel to be printed;

an energizer of the heating elements printing-line by printing-line adjacent to the selected substantially light-insensitive elongated imaging material thereby producing an image;

a transport system to transport the imaging material past and adjacent to the printhead in a transport direction with said transport system;

an image dot former with a heat energy of 50 to 200 $mJ/mm^2$ of heating element surface area;

wherein the thermosensitive element contains a substantially light-insensitive organic silver salt, a reducing agent therefor in thermal working relationship therewith and a binder; and the thermosensitive element excludes a colourless or light coloured dye precursor and also excludes an encapsulated organic silver salt in a heat-responsive microcapsule. With the substantially light-insensitive elongated imaging material, a desirable colour tone is a neutral tone as defined by CIELAB a* and b*-values and a desirable optical density, $D_{vis}$ is above 1.2 and even more desirably above 1.5.

Preferred embodiments of the present invention are disclosed in the detailed description of the invention.

BRIEF DESCRIPTION OF THE DRAWINGS

Embodiments of the present invention will be described in greater detail in the following with reference to the accompanying drawings, wherein:

FIGS. 1.1 and 1.2 show labels which can be produced using the present invention;

FIG. 2 shows a printhead positioned on an elongated imaging material;

FIG. 3.1 is a plan view of a printed label in which normal character images are printed;

FIG. 3.2 is a plan view of a printed label in which reversed character images are printed;

FIGS. 4.1–4.10 show several examples of labels with 1 to 4 label-lines;

FIG. 5.0 is a view of a thermal label-printing apparatus with a cassette loaded;

FIGS. 5.1–5.4 are partial sections along line I-II illustrating a selection switch for selecting an elongated imaging material containing an organic silver salt or another elongated imaging material.

FIGS. 9.1–9.3 illustrate a label-line comprising a plurality of printing-lines PL, each printing-line comprising 3 printing-sublines;

FIG. 10.1 shows activation pulses timing for the printhead;

FIG. 10.2 shows activation pulses according to the invention;

DETAILED DESCRIPTION OF THE INVENTION

Certain terms used in disclosing the present invention are defined below, referring to relevant drawings where appropriate.

A label is a sheet material which is attachable to an object and contains information, having two parallel edges separated by a distance of ≦12 cm measured perpendicular to the parallel edges (see examples in FIGS. 1–4).

Dot energy is the heating energy used to produce a dot.

Figure 8:
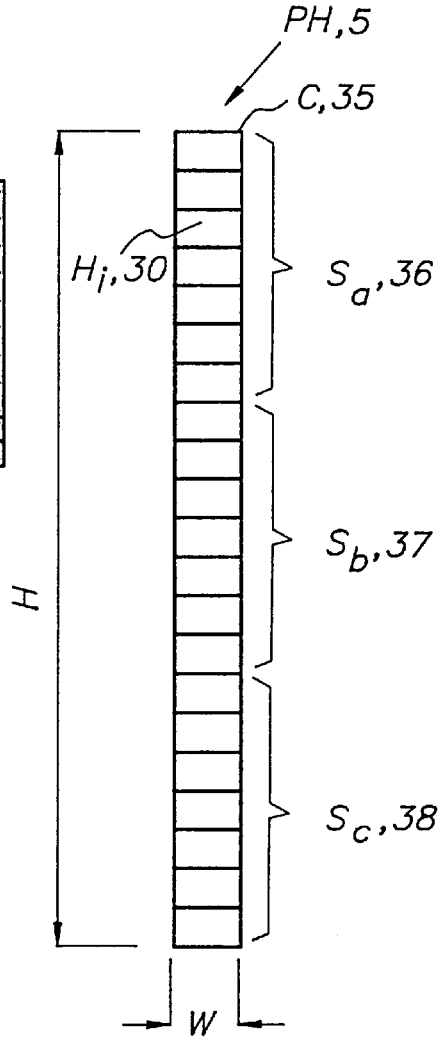
FIG. 8 is a schematic view of a printhead used in the present invention.

A printhead PH comprises at least one column C having a first number (e.g. s=3) of sections S, each section having a second number (e.g. se=10) of heating elements Hi (see FIG. 8).

Perceptible printed characters are composed of printed dots each dot representing a print pixel. A so-called label-line LL comprises at least one line of perceptible characters (e.g. text, symbols . . . ) on a label. Examples of a label-line LL are: "A", "ABC123", "1998.08.12", "Preliminary proposal!" (some other examples are illustrated in FIGS. 3–4)

A label-line LL may be parallel or non-parallel to the direction of transportation (indicated by arrow Y in FIGS. 2, 3, 6, 9) of the elongated imaging material. On a landscape label, for example, the label-line LL is substantially parallel to and on a portrait label the label-line LL is substantially perpendicular to the direction of transportation. Each label-line may be composed of a plurality of printing-lines PL. Examples of a printing-line PL are "- - - - - - - - - - -" and "- - - - - - -".

A printing-line PL is printed by a column C of heating elements Hi. The printing-line PL is substantially parallel to the column C; but the printing-line PL may be parallel or non-parallel to a label-line LL. Each printing-line is generated by a printing cycle of activation pulses in which all heating elements of a column can be activated at least once. The time taken to print a printing-line PL is a line-time LT.

Each activation pulse may either have an "off-state" (corresponding to a logical zero "0") or an "on-state" (corresponding to a logical one "1").

A line-duty-cycle Δ is the ratio of activation time to total line time for the heating elements which can be activated in producing a printing-line.

A printing-line may comprise several printing-sublines. Each printing-subline SL takes a time-slice or a time-step or a column-time (being the time wherein all heating elements of at least one section of a column can be activated once). A column-duty-cycle ▽ is the ratio of the sum of all activation-times during a column-time of all heating elements of a printing-subline divided by the column-time.

A transport system can consist of a moving belt, motor-driven drums, capstans etc.

Substantially light-insensitive means not intentionally light sensitive.

The descriptor aqueous in the term aqueous medium for the purposes of the present invention includes mixtures of water-miscible organic solvents such as alcohols e.g. methanol, ethanol, 2-propanol, butanol, iso-amyl alcohol etc.; glycols e.g. ethylene glycol; glycerine; N-methyl pyrrolidone; methoxypropanol; and ketones e.g. 2-propanone and 2-butanone etc. with water in which water constitutes more than 50% by weight of the aqueous medium with 65% by weight of the aqueous medium being preferred and 80% by weight of the aqueous being particularly preferred.

The encapsulated organic silver salt in a heat-responsive microcapsule disclosed in EP 736 799A whose use in the thermosensitive element of the present invention is preferably excluded has a wall which isolates the substances incorporated therein from the exterior at room temperature, but becomes permeable without being destroyed when pressure is applied or when heated. The microcapsule can be prepared by any of interfacial polymerization, internal polymerization and external polymerization.

Interfacial polymerization comprises emulsifying a core substance comprising an organic silver salt that has been dissolved or dispersed in an organic solvent in an aqueous solution having a water-soluble polymer therein and then forming a polymer wall around the emulsified oil droplets of the core substance.

A leuco-dye is a colourless or weakly coloured compound derived from a dye. Colourless or light coloured dye precursor leuco-dye systems whose use in the thermosensitive element of the present invention is excluded include leuco triarylmethane, indolyl phthalide, diphenylmethane, 2-anilinofluoran, 7-anilinofluoran, xanthene and spiro compounds such as disclosed in EP-A 754 564.

By the term "heat solvent" in this invention is meant a non-hydrolyzable organic material which is in a solid state in the recording layer at temperatures below 50° C., but becomes a plasticizer for the recording layer when thermally heated and/or a liquid solvent for the organic silver salt or the reducing agent.

Label-Printing

It has been surprisingly found that the image-forming behaviour of substantially light-insensitive elongated imaging materials based on organic silver salts deviates from that of other substantially light-insensitive elongated imaging materials in that the image density and image tone are critically dependent upon the conditions applying during image formation as can be seen by comparing COMPARATIVE EXAMPLES 1 to 11 with INVENTION EXAMPLES 12 to 33. Whereas in the widely used leuco dye-containing imaging materials the image density did not vary systematically with the heating energy applied to the adjacent heating element during the thermographic development process, the so-called dot energy, the image density achieved with a substantially light-insensitive elongated imaging material based on an organic silver salt appears surprisingly mainly to depend upon the heating energy applied to the adjacent heating element during the thermographic development process. Since dot energy is the product of heating power and heating pulse-length, this implies that the image density is surprisingly almost independent of the heating power. Moreover, the heating power will largely determine the temperature attained by the heating element and hence that attained by the substantially light-insensitive elongated imaging materials based on an organic silver salt in proximity to the heating element during the thermal development process. This means that the image density is almost independent of the temperature attained by the substantially light-insensitive elongated imaging material based on an organic silver salt in proximity to the heating element during the thermal development process. Furthermore this dot energy can be supplied to one or more heating elements activated to produce the dot with a particular image density i.e. the heating power (i.e. drive voltage squared divided by the heating element resistance) applied to the one or more heating elements, in one or more heat pulses and the duration of the one or more pulses.

To achieve a more neutral image tone it is preferred that for the particular dot energy required the heating power be as low as possible and the column-duty-cycle $\nabla$ be as high as possible.

Above a threshold energy, INVENTION EXAMPLES 1 to 11 show that the image density increases with increasing dot energy up to a maximum image density. The dot energy corresponding to this maximum image density has been found to be dependent upon the choice of reducing agent for a particular organic silver salt, the choice of toning agent and the ratio of binder to organic silver salt in the thermosensitive element. At still higher energies the image density decreases with further increase in dot energy. For a given binder to organic silver salt ratio and given concentration of a particular reducing agent and toning agent, the image density potential of the material has been found mainly to depend upon the weight per unit area of substantially light-insensitive organic silver salt therein.

Label-Printing Process

In the label-printing process of the present invention, the range of heat energy for the formation of an image dot is 50 to 200 mJ/mm$^2$, with 66 to 150 mJ/mm$^2$ of heating element surface area being preferred and 66 to 120 mJ/m$^2$ of heating element surface area being particularly preferred.

The label-printing process preferably comprises the further step of selecting the supply-voltage which determines the heating power, the column-time and/or the column-duty-cycle $\nabla$ for obtaining the optical density and the colour tone with the selected elongated imaging material.

The operating temperature of common thermal printheads is in the range of 300 to 400° C. and the heating time per picture element (pixel) may be less than 1.0 ms, the pressure contact of the thermal printhead with the recording material being e.g. 200–1000 g/cm$^2$ to ensure a good transfer of heat. Activation of the heating elements can be power-modulated or pulse-length modulated at constant power. Image-wise heating of the direct thermal material can also be carried out using an electrically resistive ribbon incorporated into the material. Image- or pattern-wise heating of the elongated imaging material may also proceed by means of pixel-wise modulated ultra-sound.

In a preferred embodiment of the label-printing process of the present invention the energisable heating elements are grouped in at least two sections S. In a further preferred embodiment of the label-printing process of the present invention the printhead consists of more than one column of energisable heating elements. In a still further preferred embodiment of the label-printing process of the present invention the energising of the heating elements printing-line by printing-line is carried out section by section.

In another preferred embodiment of the label-printing process of the present invention, the heating power is as low as possible and the column-duty-cycle $\nabla$ is as high as possible in achieving a particular heat energy for the formation of the image dot. Possible embodiments of the invention having the same effect of lowering the power and increasing the duty cycle comprise e.g.: reducing the voltage and increasing the duty cycle while keeping the column-time constant; reducing the voltage and increasing the column-time while keeping the duty cycle constant; and reducing the voltage, increasing the duty cycle and increasing the column-time.

In another preferred embodiment of the label-printing process of the present invention, a configuration memory contains characteristics of at least one elongated imaging material relating to a range of available column-times, to a range of available transportation speeds, to a range of available voltages.

In another preferred embodiment of the label-printing process according to the present invention, the configuration memory contains characteristics of at least one elongated imaging material including the characteristics of a elongated imaging material requiring a maximal available voltage, to a minimal available column-duty cycle $\nabla$, and to a predefined transportation speed.

In another preferred embodiment of the label-printing process of the present invention the heating power per heating element is in accordance with $P \leqq P_{max}=3.3\ W/mm^2+(9.5\ W/mm^2 \times \nabla)$, where $P_{max}$ is the maximal value over all heating elements of the time averaged power density P (expressed in $W/mm^2$) dissipated by a heating element during the column-line-time.

In another preferred embodiment of the label-printing process of the present invention the column is at an angle to the transport direction of between 0 and 100°, with an angle between 90 and 99° being particularly preferred.

In another preferred embodiment of the label-printing process of the present invention the thermal head is powered by a DC energy source, with the DC energy source being one or more batteries being particularly preferred.

In yet another preferred embodiment of the label-printing process of the present invention selection of the supply-voltage, the column-time and/or the column-duty-cycle $\nabla$ for obtaining the optical density and the colour tone with the selected elongated imaging material includes:

generating a signal indicative of the elongated imaging material;

retrieving from the configuration memory values for the supply-voltage, for the column-time and for the column-duty-cycle $\nabla$ corresponding to the optical density and the colour tone for the selected elongated imaging material.

Such selection could be achieved by switching port lines on the microprocessor to change the control reference voltage or feed back path in the power supply. Alternatively some sort of variable voltage regulator could be used. Some preferred embodiments of such selection possibilities will be explained in full detail below, in relation to FIGS. 5.1 to 5.4.

Apparatus for the Label-Printing Process

The apparatus for the label-printing process according to the present invention will be elucidated using FIGS. 1 to 14. FIG. 1.1, for example, shows a label 1. When a print operation is started on a label-printer according to the present invention, a length of an elongated imaging material (e.g. 20 mm) extends between the printhead and a cutting mechanism of the label-printing apparatus. A tab cut defines the finished label. In a so-called "strip label" mode, a tab cut is performed at a series of locations. This provides the possibility of printing a continuous elongated imaging material with a series of labels 1 separated by individual tab cuts (e.g. with the printed position 2 centralised as shown in FIG. 1.2).

As can be seen from FIG. 2, the printhead PH (5) for such a label-printer comprises a plurality of heating elements 30 which are selectively activated, i.e. heated. The printhead 5 comprises a column 35 of heating elements 30 which has a height which generally corresponds to the maximum width of the image capable of being printed. All of the heating elements are arranged so as to be capable of being activated simultaneously, if necessary.

The printhead 5 is provided with an array of a plurality of heating elements, the array generally being directed perpendicular to the feeding direction Y (6) of the elongated imaging material 3, the elongated imaging material being imagewise heated by the printhead PH. In a preferred embodiment of the label-printing process of the present invention the column is at an angle to the transport direction of between 0 and 100°, with an angle between 90 and 99° being particularly preferred. This is illustrated, non-restrictively, in FIG. 2 by a column direction (ref. 9) which is indicated as V or V'.

The selective activation of the heating elements of the printhead may produce normal image 12 as shown in FIG. 3.1 (as well as in FIGS. 1.2 and 4.1 to 4.10), or reversed image 13 such as shown in FIG. 3.2. The reversed image is obtained by turning the normal image 180 degrees with respect to a line 11 parallel to the elongated imaging material feeding direction indicated by an arrow Y in FIG. 3.2. It should be mentioned that, a label-line LL, having a direction indicated by arrow U (8 in FIG. 2), may be parallel or non-parallel to the direction of transportation Y (6) of the elongated imaging material. For example, on a landscape label, label-line-direction U is substantially parallel to the transport-direction Y, whereas, on a portrait label, label-line-direction U is substantially perpendicular to the transport-direction Y.

As mentioned before, FIG. 3.1 is a schematic view of a printed label in which normal character images 12 have been printed, and FIG. 3.2 is a schematic view of a printed label in which reversed character images 13 have been printed.

FIGS. 4.1 to 4.10 show several examples of labels with up to 4 label-lines (21–24). From FIG. 4, it is clear that e.g. one (small or medium or large) text, or two (small or medium) texts or even four (small) texts may be printed at the same time on an elongated imaging material 3.

A printhead 5 comprising e.g. 30 heating elements each (about) 0.142 mm long along the printhead and 0.016 mm apart, would result in a total "printing height" of (about) 4.7 mm. In such embodiment, the discrepancy between the label-height of e.g. 12 mm versus the printing height of 4.7 mm (see FIG. 4.5), leaves a non-printed area or free margin of about 4 mm unprinted on either side. Free margins are also left in the case of label heights of e.g. 6 mm, 9 mm, 19 mm, or 32 mm, or even 120 mm.

The electronic control of the heating elements varies as a function of the required size and style of the printed labels. Possible variations are the heights of the characters (normal or medium, small, large), the widths of the characters (normal, wide, extra wide), the fonts of the characters (normal, bold, outline, italic, boxed, underlined, shadowed, inverted), text alignment (to the left, the middle, the right), portrait or landscape labels.

In a preferred embodiment of the present invention, one set of characters is used with e.g. a single dot for a narrow font; two dots side by side in the transport direction Y for a normal font; and four dots in a row in the transport direction for a wide font. Furthermore, e.g. two printing heights may be used: the full height for capitals and numbers, and a standard height. In another preferred embodiment, an algorithm is used to generate boxing, underlining etc. Any other print sizes require a different printhead configuration.

FIG. 5.0 is a schematic of a cassette bay 40 in a label-printer 150. The cassette bay 40 accommodates a thermal printhead 5 and a platen roll 44 which together define a print location P in a manner which is known in the art. The printhead 5 is pivotable about a pivot point 48 so that it can be brought into contact with the platen roll 44 and moved away from the platen roll to enable a cassette to be removed and replaced.

A cassette inserted into the cassette bay is denoted by reference numeral 50. The cassette contains a spool 52 of elongated imaging material to be printed. The elongated imaging material 3 to be printed is guided by a guide mechanism, which is not shown, through the cassette, exiting the cassette shortly after having passed the print location through an outlet O to be routed to a cutting location C. The elongated imaging material to be printed passes through the print location P with its imaging layer 31 in contact with the printhead.

In the label-printer 150 illustrated in FIGS. 5.0 and 6, the platen roll 44 is driven so that as it rotates it guides the elongated imaging material 3 to be printed through the print location P during printing. As this occurs, the material is printed and fed out from the print location P to the cutting location C. The cutting location C is provided adjacent to the wall of the cassette close to the print location P. Since the imaging material is pulled out of the cassette by driving the platen roll, there is no need for a further elongated imaging material advance mechanism. The cutting location C is arranged close to the print location P. The portion of the wall of the cassette where the cutting location C is defined is denoted by reference numeral 62. A slot 64 is defined in this wall portion 62. The elongated imaging material to be printed is transported from the print location P to the cutting location C, where it is supported by facing wall portions on either side of the slot 64.

The label-printer 150 includes a cutting mechanism denoted by reference numeral 60. This cutting mechanism 60 includes a cutter transport member which carries a blade 66. The blade severs the elongated imaging material 3 and then enters the slot 69. FIG. 5.0 shows the cutting mechanism in its ready-to-cut state, that is with the blade above the elongated imaging material. This permits the free leading edge of the elongated imaging material to be driven through the cutting location C without the risk of catching on it or being deflected by it.

As mentioned above, a preferred embodiment of the present invention comprises selecting the supply-voltage, the column-time and/or the column-duty-cycle $\nabla$ for obtaining a desired optical density with a selected elongated imaging material. Such selection could be achieved by switching port lines on the microprocessor to change the control reference voltage of feed back path to the power supply. Alternatively some sort of variable voltage regulator could be used. A mating feature in a cassette could operate a micro-switch which would change the voltage such as shown in FIGS. 5.1 and 5.2.

In FIG. 5.1 a partial diagrammatic section along line I-II in FIG. 5.0 is shown. In FIG. 5.1, reference numeral 80 denotes the floor of the cassette receiving bay 40. Reference numeral 50 denotes a cassette of the type shown in FIG. 5.0 which contains a elongated imaging material containing a substantially light-insensitive organic silver salt, 3. Reference numeral 82 denotes a switch and reference numeral 84 an actuating part of the switch 82. The switch 82 may be a standard low cost two-position slide switch, conveniently mounted below the cassette bay floor 80, so that the actuating part 84 protrudes above the cassette bay floor 80 through a slot 86. The actuating part 84 of the switch 82 is shown in a first position in FIG. 5.1. This position is the position for the elongated imaging material containing a substantially light-insensitive organic silver salt, 3. The cassette 50 holding the elongated imaging material containing a substantially light-insensitive organic silver salt, 3, has a recess 88 in its underside which is located to accommodate the actuating part of the switch 82 when it is in the elongated imaging material containing a substantially light-insensitive organic silver salt printing mode position. The switch 82 is connected to the microprocessor chip 170 via input 90. This input 90 indicates to the microprocessor chip 170 the position of the actuating part 84 of the switch 82. The microprocessor chip 170 then uses this information to determine whether the label-printer is in the elongated imaging material containing a substantially light-insensitive organic silver salt position or the mode for another type of elongated imaging material, for example one based on leuco dyes.

The actuating part 84 of the switch 82 is movable into a second position which is indicative of a mode for the printing of this other type of elongated imaging material. This is shown in FIG. 5.2. In the position for this other type of elongated imaging material, it is identified that a cassette containing this other type of elongated imaging material is present. Thus a cassette housing this other type of elongated imaging material would have a recess located in a position to accommodate the actuating part 84 in its position for this other type of elongated imaging material. However, this is not illustrated. FIG. 5.2 does illustrate how the actuating member 84 of the switch 82 prevents an incorrect cassette form being inserted, with reference numeral 50 denoting a cassette as shown in FIG. 5.1 having a elongated imaging material containing a substantially light-insensitive organic silver salt 3 and a recess 88 in a location intended to accommodate the actuating part 84 in its first position. With this embodiment, it is possible to identify whether or not the label-printer 150 should operate in the mode for printing a elongated imaging material containing a substantially light-insensitive organic silver salt or the mode for printing another elongated imaging material and it can also prevent a user from inserting the incorrect type of material.

It should be appreciated that the arrangement shown in FIGS. 5.1 and 5.2 can be modified so that the recess provided in the bottom of the elongated imaging material containing a substantially light-insensitive organic silver salt cassette and the cassette for another elongated imaging material is large enough to accommodate the actuating part 84 of the switch 82, regardless of the position of that switch 82.

FIGS. 5.3 and 5.4 illustrate an alternative way in which a specific thermal printing mode can be selected. Showing a diagrammatic section along line I-II in FIG. 5.0. In FIG. 5.3 reference numeral 50 denotes a cassette which contains an elongated imaging material containing a substantially light-sensitive organic silver salt, whilst reference numeral 81 denotes the floor of the cassette receiving bay 50. The cassette 50 has a recess 100 which is arranged to accommodate an actuating member 102 of a switch 82. The actuating member 102 is resiliently supported by a spring 104 which biases actuating member 102 away from a base member 106. Consequently, no electrical contact is made between actuating member 102 and base member 106. In FIG. 5.4 reference numeral 51 denotes a cassette containing another type of elongated imaging material (e.g. based on leuco dyes). This cassette 51 does not have a recess and accordingly, the actuating member 102 is pushed downwards towards base member 106. A contact 108 on actuating member 102 is thus in contact with a contact 110 on base member 106. This provides a signal to the microprocessor indicating the presence and the type of the cassette (referred to as 50 or 51). And consequently, the microprocessor can modify the operation of the printhead (see also FIG. 12).

Figure 6:
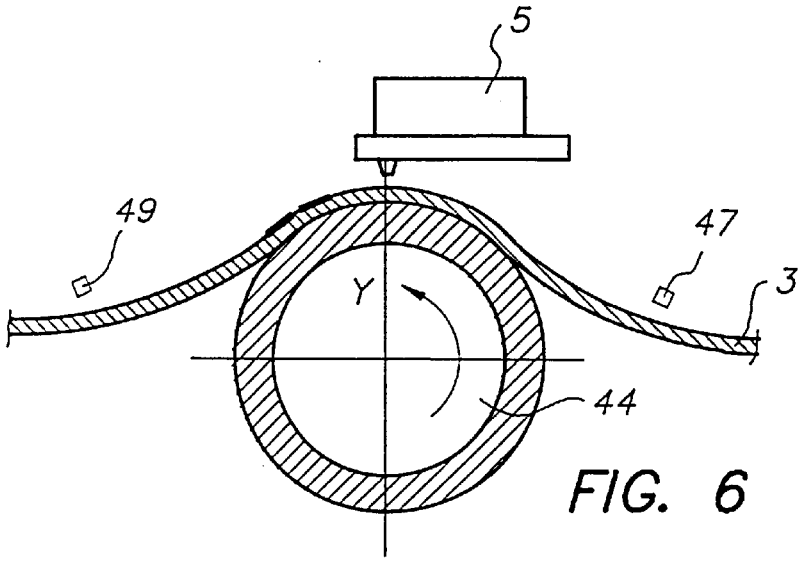
FIG. 6 is a schematic cross-sectional view of a direct thermal elongated imaging material printer.

In FIG. 6, a schematic shows how the thermal printer 150 operates in accordance with the present invention. This apparatus is capable of printing one line of pixels at a time on an elongated imaging material including a support and a thermosensitive element comprising an organic silver salt, which is generally in the form of a sheet. The elongated imaging material is mounted on a rotatable platen roll 44, driven by a drive mechanism (not shown) which continuously advances the platen roll and the elongated imaging material 3 past a stationary thermal printhead 5. This printhead presses against the platen roll and receives the output of the driver circuits. The thermal printhead normally includes a plurality of heating elements equal in number to the number of pixels in the image data present in a line memory (not shown). The imagewise heating of the heating element is performed on a line by line basis, with the heating resistors geometrically juxtaposed each along another and with gradual construction of the output density. Each of these resistors is capable of being energised by heating pulses, the energy of which is controlled in accordance with the required density of the corresponding picture element.

The output energy increases as the value of the required density increases, resulting in an increase of the optical density of the hardcopy image on the imaging element. On the contrary, a lower value of input image data causes the heating energy to be decreased, giving an image with a lower optical density.

A sensor 47 positioned adjacent to the path of the elongated imaging material, upstream of the printhead, generates a signal indicative of the specific type of the elongated imaging material 3. A further sensor 49, positioned adjacent the path of the elongated imaging material, downstream of the printhead, generates a signal indicative of the quality of the printed image.

Figure 7:
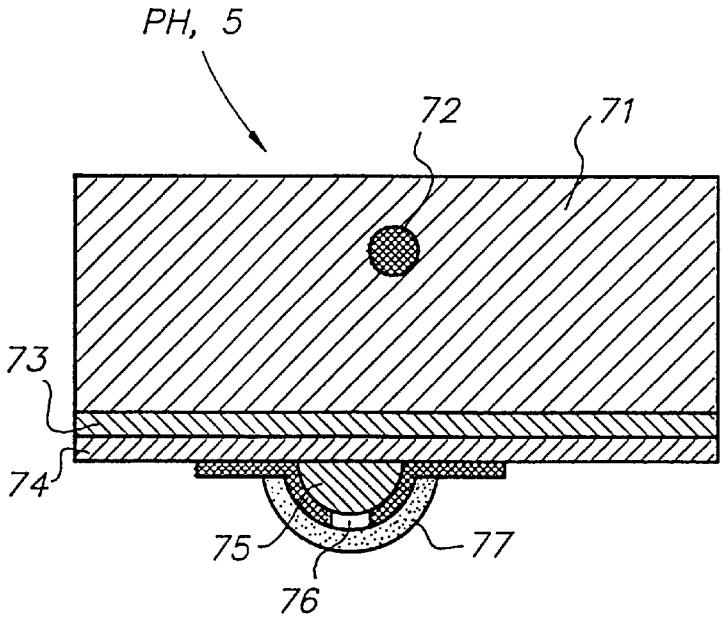
FIG. 7 is a detailed cross section of a printhead.

FIG. 7 is a detailed cross section of a printhead 5, indicated as part PH in FIG. 2 and containing a heat sink mounting 71, a temperature sensor 72, a bonding layer 73, a ceramic substrate 74, a glazen bead 75, a heating element 76 and a wear resistant layer 77. The printhead may be produced using thick film or thin film technology.

Reference is made now to FIG. 8, which is a schematic view of a printhead PH used in embodiments of the presents invention. The printhead PH is a thermal printhead 5 comprising a column 35 of a plurality of heating elements 30, $H_i$. The printhead is preferably only one heating element wide (W) and the column extends in a direction perpendicular to the lengthwise direction of the elongated imaging material. The height H of the column of heating elements is preferably equal to the maximum width of the elongated imaging material to be printed with the label-printing apparatus. Where more than one width of elongated imaging material is used, the printhead column will generally have a height equal to the largest width of elongated imaging material to be printed.

The printhead 5 comprises a column C (35) having a first number (e.g. s=3) of sections S (36–38), each section having a second number (e.g. se=10) of heating elements Hi (30). The heating elements of the printhead are preferentially divided into three sections Sa, Sb and Sc as can be seen from FIG. 8. Each section of heating elements may be activated in succession; in this example, the maximum number of heating elements of the printhead activated at any one time is equal to one third of the total number of heating elements.

As to the dimensions of the heating elements, to (spatial) resolution and to addressability, it first has to be mentioned that heating element-width is e.g. 115 $\mu$m, and that element-height is e.g. 142 $\mu$m with a free distance of 16 $\mu$m, resulting in a height-pitch of 158 $\mu$m. Thus, in this preferred embodiment, the (vertical or height or) longitudinal resolution is 160 dpi, this being consistent with an element-pitch of 158 $\mu$m. With a 40% dot overlap in the transport direction the resolution is 320 dpi in the transport direction and 160 dpi in the lateral direction.

In a further preferred embodiment of the present invention, illustrated in FIG. 9, to be explained in the next paragraph, each printing-line PL is carried out in a third number (e.g. sl=3) of sequential time-slices (or printing-sublines or time-steps). In a still further preferred embodiment, each heating element is activated a fourth number of times (e.g. 2) within a printing cycle(or line time).

FIGS. 9.1–9.3 give a deeper insight into the printing cycle, wherein each label-line (e.g. "F", ref. 21) comprises a plurality of printing-lines PL (e.g. "I" and "II", ref. 25, 26) and wherein each printing-line PL preferentially is carried out in a third number (e.g. sl=3) of sequential 'printing-sublines SL'. (or time-slices or time-steps; e.g. sl1, 1-sl1,3; ref. 27–29).

By taking a closer look on the drawings, one can differentiate following important characteristics:

- Each printing-line PL (25, 26) is carried out in a third number (e.g.sl=3) of sequential time-slices (or sublines or time-steps).
- Each printing-subline SL (27, 28, 29) is generated by activating once each heating element 30 of at least one section 36, 37, 38.
- Each printing-subline SL takes a time-slice or a time-step or a column-time (and hence, is the time wherein all heating elements of at least one section of a column can be activated once)
- Each heating element 30 is preferentially activated a fourth number of times (e.g. 2) within a printing cycle during a corresponding line time.

Reference will now be made to FIG. 10.1 which shows a strobe pulse timing for the printhead operating in a direct thermal printing mode. Each section Sa, Sb, Sc of the printhead is strobed (or activated) e.g. twice in succession for each set of print information. By further preference, as will be described in more detail hereinafter, two out of the three sections Sa, Sb, Sc of the printhead are strobed or activated at any one time. Line VSa represents activation of the first section Sa of the printhead, line VSb represents the activation of the second section Sb of the printhead whilst line Vsc represents the activation of the third section Sc of the printhead.

Referring to the first section of the printhead, those heating elements which are to be activated are activated twice in succession for the same set of print information. Each pulse or activation period lasts for a time period T (e.g. 1.53 ms) with a period of time T' (e.g. 2.30 ms) between the first and second activations of the selected heating elements of the first section Sa of the printhead. It should be noted that because each set of print information is supplied twice to the printhead, exactly the same heating elements of the first section Sa of the printhead are activated during the first and second strobe pulses applied to that first section.

Within a predetermined line time (e.g. 11.5 ms), the heating elements of the second section Sb of the printhead are also to be activated; they are also activated twice, in succession for each set of print information. The second strobe pulse for the first section Sa coincides with the first strobe pulse for the second section Sb of the printhead. The two activation periods or strobe pulses for the second section Sb of the printhead are each equal in length to the activation periods of the strobe pulses for the first section Sa. Similarly, with the third section Sc of the printhead. The two activation periods or strobe pulses for the second section Sb of the printhead are each equal in length to the activation periods of the strobe pulses for the first section Sa. Similarly, with the third section Sc of the printhead, the first activation period or strobe pulse for the third section Sc coincides with the second activation period or strobe pulse for the second section Sb of the printhead. Once again, the activation periods (strobe pulses) for the third section of the printhead are the same length as those of the first and second sections Sa and Sb. The second strobe pulse of the third section Sc coincides with the first strobe pulse of the first section Sa.

In FIG. 10.2 activation pulses are shown according to the present invention. Herein, the supply voltage and column-time and/or column-duty-cycle $\nabla$ are such as to produce a heat energy for the formation of an image dot in the range of 50 to 200 mJ/mm$^2$ of heating element surface area. By doing so, a label-printing process is provided for printing labels from a monosheet elongated imaging material which have excellent light stability and image tone.

Figure 11:
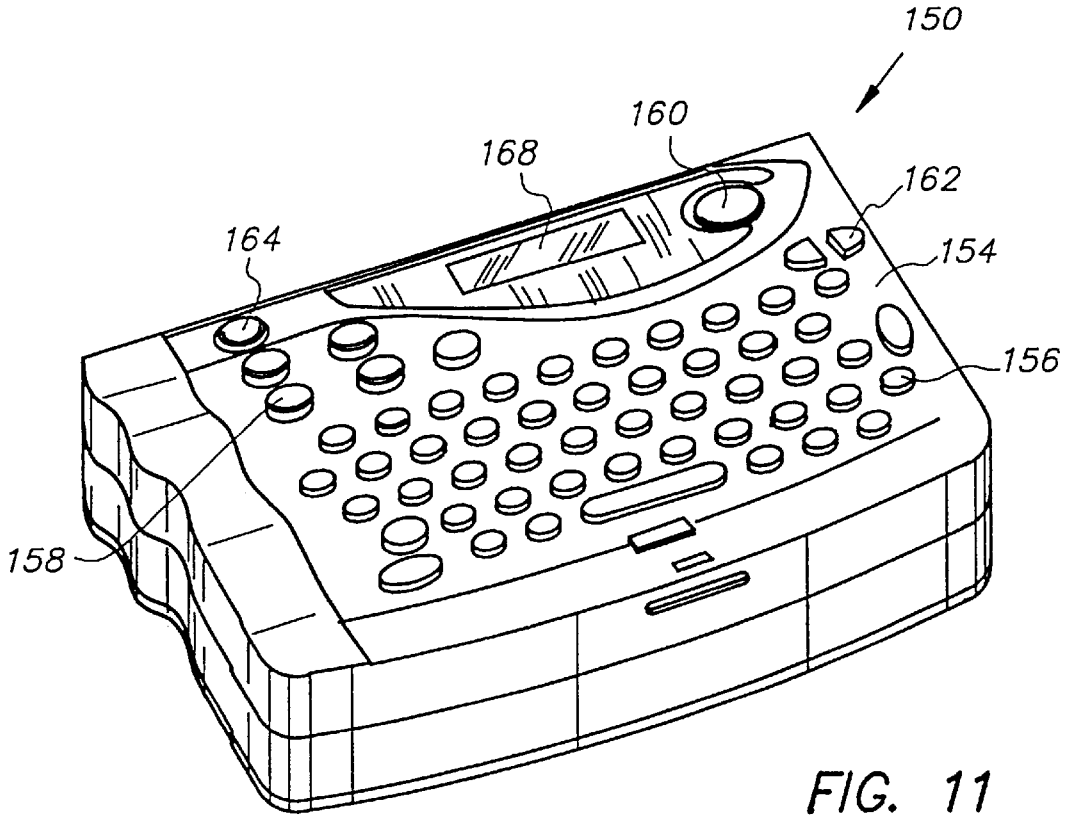
FIG. 11 is a perspective view of a direct thermal elongated imaging material printer.

FIG. 11 shows a label-printer 150. The label-printer comprises a keyboard 154 which has a plurality of data entry keys and in particular comprises a plurality of numbered, lettered and punctuation keys 156 for inputting data to be printed as a label and function keys 158 for editing the input data. These function keys may, for example, change the size or font of the input data. The keyboard also comprises a print key 160 which is operated when it is desired that a label be printed together with elongated imaging material feeding keys 162. In addition, the keyboard has an on/off key 164 for switching the label-printing apparatus on and off. A cursor can be moved over a display 168 by means of cursor keys.

The label-printer 150 also has a liquid crystal display 168 (e.g. a LCD) which displays the data as it is entered. The display allows the user to view all or part of the label to be printed which facilitates the editing of the label prior to its printing. Additionally, the display can also display messages to the user, for example error messages or an indication that the print key should be pressed. The display is driven by a display driver which can be seen in FIG. 12.

Figure 12:
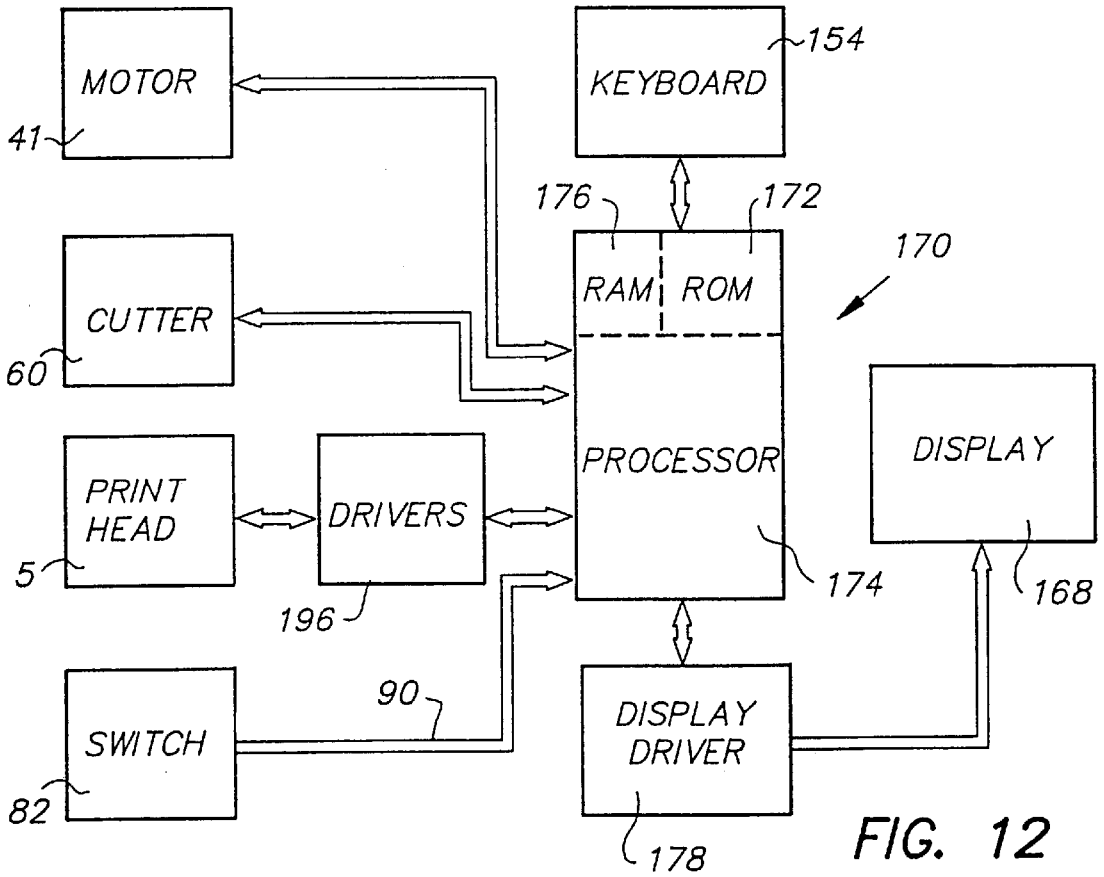
FIG. 12 is a simplified block diagram of the control circuitry for the printer.

FIG. 12 shows the basic control circuitry for controlling the label-printer 150 comprising a microprocessor chip 170 having a read only memory (ROM) 172, a microprocessor 174, and random access memory capacity indicated diagrammatically by RAM 176. The ROM stores data defining the characters and/or symbols which can be selected via the keyboard 154. The ROM may also store various algorithms. For example, an algorithm for reconstructing the font data may be stored where data compression techniques have been used and/or sizing or print style algorithms may be stored so that print information for the desired size and/or style of characters etc. can be generated.

The microprocessor is controlled by software stored in the ROM and when so controlled acts as a controller. The microprocessor chip 174 is connected to receive label data input from the keyboard 154. The microprocessor chip outputs data to drive the display 168 via the display driver 174 to display the image to be printed on the label (or a part thereof) and/or a message or instructions for the user. The microprocessor chip also outputs data to drive the printhead 5 which prints an image onto the elongated imaging material thereby forming a label 1. The microprocessor chip also receives an input which indicates whether the label-printing apparatus is to operate in a first mode (e.g. a printing mode for printing with a elongated imaging material containing a substantially light-insensitive organic silver salt) or in a second mode (e.g. a printing mode for printing a leuco-dye based elongated imaging material). This input may be connected to a switch 82 having one position when the first printing mode is to be selected and a different position when the second printing mode is to be selected.

In particular, the microprocessor chip is arranged to generate print information to control the operation of the printhead. This print information is generated from the data input by the user via the keyboard in accordance with the data stored in the ROM and any stored algorithms. In particular, when a key of the keyboard is depressed, the related character code is stored in the edit buffer in RAM at the cursor location. When the PRINT key is pressed each character code in the edit buffer in RAM is read in turn and used to extract the related print data stored in ROM for each character. The print data are then manipulated to define the print information. This manipulation may involve the application of one or more stored algorithms. This print information comprises a plurality of set of print information. Each set of print information corresponds to a column of data. These columns of data are applied in succession to the printhead. Each column of data is supplied twice to the printhead. Each column of data defines the status of each heating element in the printhead, i.e. whether each heating element is on or off. In some embodiments, the printhead is divided into two sections or more, e.g. three sections (indicated as Sa, Sb, Sc). In that case, each set of print information would relate to one section of the printhead only.

Finally, the microprocessor chip also controls the motor 41 for driving the elongated imaging material through the label-printing apparatus. The microprocessor chip may also control the cutting mechanism 60 to allow lengths of elongated imaging material to be cut after an image has been printed to define the labels. Alternatively, the cutting mechanism may be manually operable.

Data relating to each character or symbol etc., printable on the elongated imaging material 3 is stored in the ROM 172. The data stored in the ROM could be in the form of a 'n' dot font data which represents each character by a 'n×m' bit map (in case of non-square characters), a 'n×n' bit map (in case of square characters), or as an outline font (Bezier characters). Preferably, the font data are stored in a simple, compressed form in order to reduce the required storage capacity. Thus, the characters are stored in a form representing sticks (rectangles) and portions of curves. Mirror functions can also be used. Thus, information on the size and position of the rectangles, respectively of the widths (i.e. thickness), radii, angles (usually 90° or 180°) and positions of circular arcs constituting a character may be stored in the ROM. When the character is symmetrical, as an H, the second half of the character can be expanded by mirroring the first half. Similarly, a C contains the same curve as a D, thus the same definition can be used, but inverted (mirrored) in one case. During printing, or for display purposes, the stored character information is recalled and expanded into the appropriate dot pattern. Such storage mode would be a way of allowing proportional sizing of the characters.

The label-printer 150 allows labels 1 to be composed and displayed on the display using the various keys. In particular, the ROM 172 stores information relating to alphanumeric characters and the like which are associated with respective keys 156, as well as functions associated with the function keys 158. When a key 156 is depressed, data concerning the associated character or the like is retrieved from the ROM 142 and then stored in the RAM 176. The data stored in the RAM may be in the form of a code which identifies the character. The microprocessor 174, in accordance with the data stored in the RAM, generates pixel data which is transmitted in one form column by column to activate the printhead and in another form to be displayed on the display. Data concerning a function may be retrieved from the ROM in response to activation of one or more of the function keys 158. These data may take the form of a flag. The pixel data are generated by the microprocessor 174 and sent to the printhead 5 and the display 168 will take into account the data relating to one or more functions stored in the RAM 176. As will be appreciated, the keys 156, 158 of the keyboard have predetermined functions associated therewith which causes predetermined data associated with a particular function to be retrieved from ROM 172.

Figure 13:
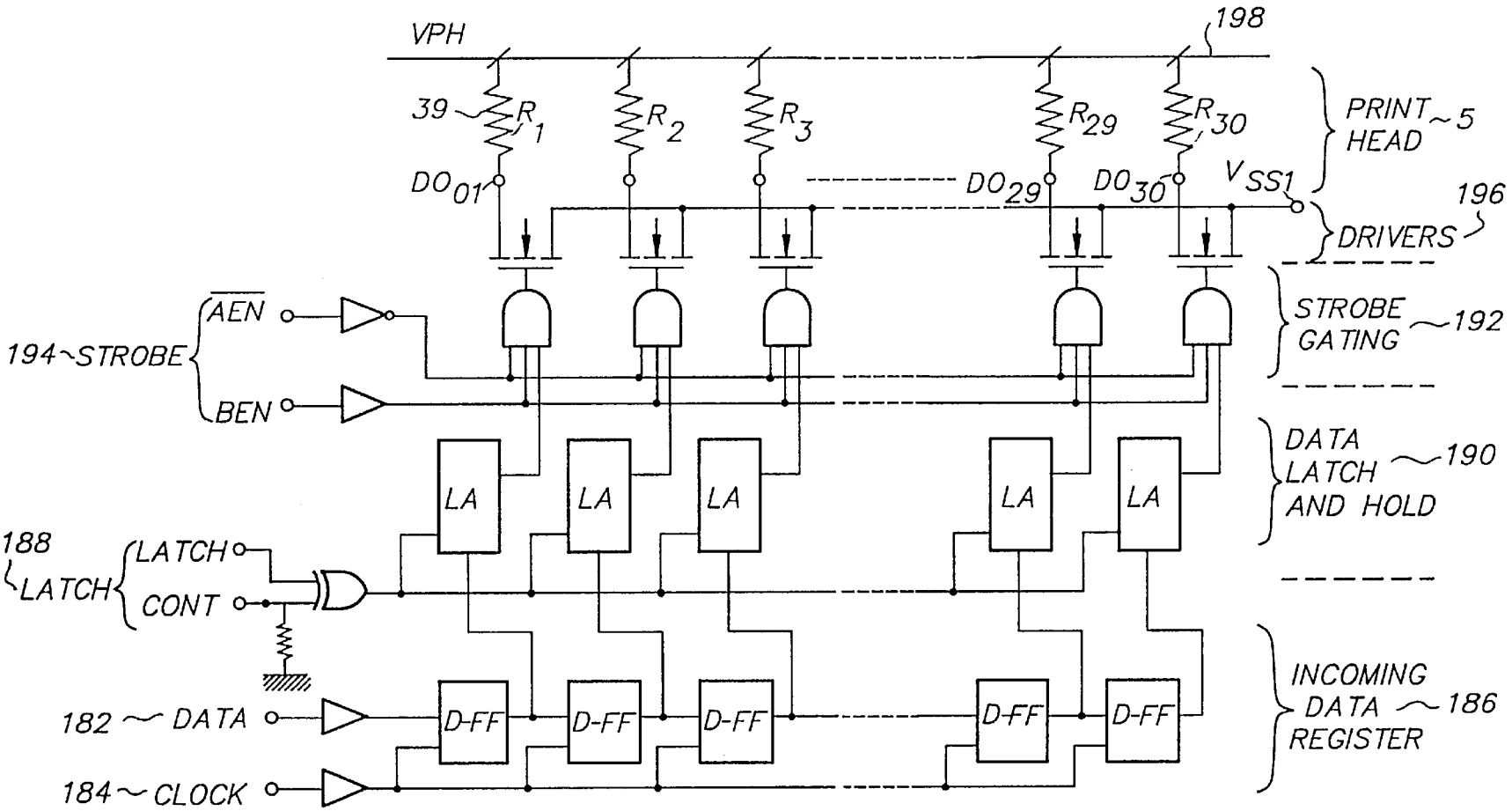
FIG. 13 is a data flowchart of a label-printer according to the present invention.
Figure 14:
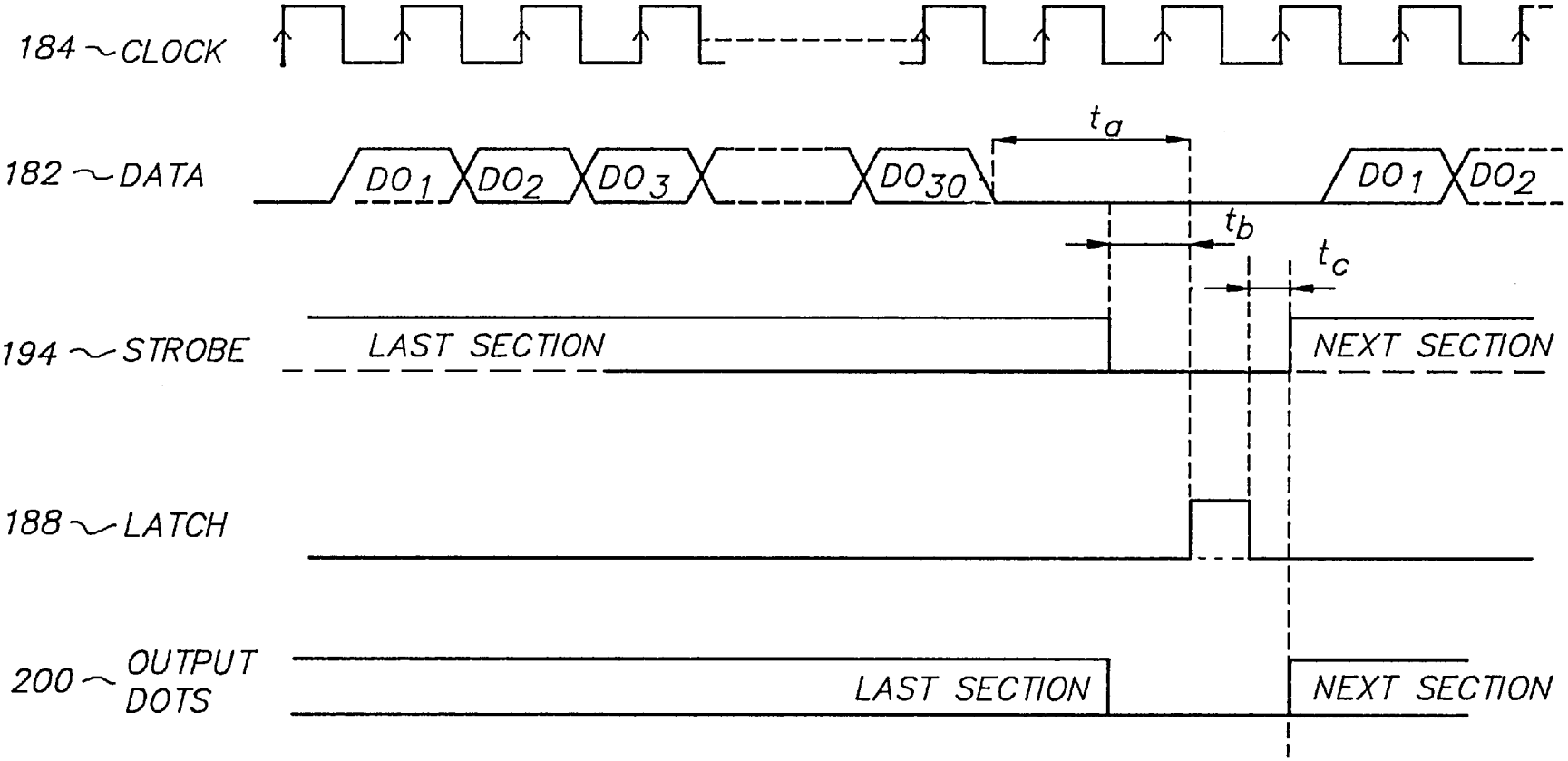
FIG. 14 is a data timing diagram of a label-printer according to the present invention.

Further explanation of a preferred embodiment of the present invention will be given with reference to FIGS. 12, 13 and 14. FIG. 13 is a data flowchart of a label-printer 150 according to the present invention. FIG. 14 is a logic data timing diagram of a label-printer 150 according tot the present invention. Herein, LATCH 188 and STROBE 194 are active HIGH and negated LOW.

Data is transferred serially from the microprocessor 174 by means of synchronous clocking using DATA (ref. 182) and CLOCK (184). When the data has been downloaded into the printhead driver's incoming data register 186, any previous STROBE cycle not already finished by the negating STROBE is terminated.

LATCH (188) is used to capture the new data (ref. 182) in the incoming register 186 and to store them temporarily in DATA LATCH AND HOLD MEANS 190. From now on, these data are available to the appropriate logical gates indicated as STROBE GATING 192. Then the STROBE signal 194 is asserted for the required duration. For data which is HIGH, the output drivers 196 (here e.g. FET-transistors) are turned on when STROBE 194, or more precisely STROBE GATING 192, is asserted causing current to flow through the resistive heating element 39 (e.g. R1 to R30) of the printhead from the VPH voltage rail 198. If the data 182 is LOW, the associated strobe gating 192 and hence the associated driver 196 does not turn on.

In relation to FIG. 14, it may be indicated that the time-length of the data train 182 (e.g. in a range smaller than 1 ms) of generally is much smaller than the time-length of the strobe 194 (e.g. in a range greater than 1 ms), and hence smaller than the heating of the heating elements 39 or than the output of dots 200. Furthermore, a LATCH-signal 188 is given after the receipt of all new data 182 (see time span ta) and after the ending of a STROBE-signal 194 (see time-span tb). Also, the next STROBE-signal 194 starts some time after the ending of a foregoing LATCH-signal 188 (see time-span tc).

In addition, the output drivers 196 may be part of the print head, or (as illustrated in FIG. 12) may be part of a separated integrated circuit IC on the printed circuit board PCB.

Substantially Light-Insensitive Elongated Imaging Materials Containing an Organic Silver Salt for the Production of Labels A preferred substantially light-insensitive elongated imaging material used in the present invention for the production of labels, includes a support, a thermosensitive element and an attaching layer. The attaching layer is, once an optional protective foil has been removed, the outermost layer on the same side of the support as the thermosensitive element or the outermost layer on the side of the support not provided with the thermosensitive element. This attaching layer provides adhesion upon contact with the surface of an object to which it is to be attached under the conditions of attachment. This object is a solid whose surface may, for example, be plastic, paper, metal, wood, glass, ceramic etc. Such adhesion is a co-operative effect between the attaching layer and the surface of the object to which it is attached and is influenced by the conditions of attachment. Therefore the choice of attaching layer is dependent upon the surface of the object to which it is to be attached, i.e. the absence of species such as particles, adsorbed solvent or water, oxidized layers, grease etc. which inhibit the adhesion process, and the conditions under which attachment takes place e.g. the application of heat, pressure, solvent etc. This attaching layer may, for example, be a single or multi-component, cold, hot-melt or pressure resinous adhesive. The protective foil may, for example, be plastic, metallic or a glassine-based paper coated e.g. with a silicone layer.

The support of the imaging layer may be further provided with a dyed or pigmented transparent layer to provide a coloured background for the image on the label. It is preferred that the elongated imaging material used in the present invention is transparent i.e. is capable of transmitting visible light without appreciable scattering.

Thermosensitive Element

The substantially light-insensitive elongated imaging material used in the present invention comprises a thermosensitive element containing a substantially light-insensitive organic silver salt, a reducing agent therefor in thermal working relationship therewith and a binder. This thermosensitive element excludes colourless or light coloured dye precursor leuco-dye systems and also excludes encapsulated organic silver salt in a heat-responsive microcapsule. Furthermore, the thermosensitive element may comprise a layer system in which the ingredients may be dispersed in different layers, with the proviso that the substantially light-insensitive organic silver salt and the reducing agent are in thermal working relationship with one another i.e. during the thermal development process the reducing agent must be present in such a way that it is able to diffuse to the substantially light-insensitive organic silver salt particles so that reduction of the substantially light-insensitive organic silver salt can take place.

Organic Silver Salts

Preferred substantially light-insensitive organic silver salts for use in the thermosensitive element of the substantially light-insensitive elongated imaging material used in the present invention, are silver salts of aliphatic carboxylic acids known as fatty acids, wherein the aliphatic carbon chain has preferably at least 12 C-atoms, which silver salts are also called "silver soaps". Combinations of different organic silver salts may also be used in the imaging materials of the present invention.

Organic Reducing Agents

Suitable organic reducing agents for the reduction of the substantially light-insensitive organic silver salts are organic compounds containing at least one active hydrogen atom linked to O, N or C.

The choice of reducing agent influences the thermal sensitivity of the imaging material and the gradation of the image. Imaging materials using gallates, for example, have a high gradation. In a preferred embodiment of the present invention the thermosensitive element contains a 3,4-dihydroxyphenyl compound with ethyl 3,4-dihydroxybenzoate, butyl 3,4-dihydroxybenzoate and 3,4-dihydroxybenzoic acid being particularly preferred.

Binder

The thermosensitive element of the substantially light-insensitive elongated imaging material used in the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatin and modified gelatins, such as phthaloyl gelatin, polysaccharides, such as starch, gum arabic and dextrin, and water-soluble cellulose derivatives. Suitable water-dispersible binders are any water-insoluble polymer.

As the binder to organic silver salt weight ratio decreases the gradation of the image increasing. Binder to organic silver salt weight ratios of 0.2 to 6 are preferred with weight ratios between 0.5 and 3 being particularly preferred.

The above mentioned binders or mixtures thereof may be used in conjunction with waxes or "heat solvents" to improve the reaction speed of the organic silver salt reduction at elevated temperatures.

Toning Agents

In order to obtain a neutral black image tone in the higher densities and neutral grey in the lower densities, the substantially light-insensitive elongated imaging material used in the present invention may contain one or more toning agents. The toning agents should be in thermal working relationship with the substantially light-insensitive organic silver salt and reducing agents during thermal processing. Any known toning agent from thermography or photothermography may be used.

Stabilizers and Antifoggants

In order to obtain improved shelf-life and reduced fogging, stabilizers and antifoggants may be incorporated into the substantially light-insensitive elongated imaging material used in the present invention. Suitable stabilizers compounds for use in the elongated imaging material used in the present invention are represented by general formula I:

(I)

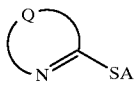

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide.

Surfactants and Dispersants

Surfactants and dispersants aid the dispersion of ingredients which are insoluble in the particular dispersion medium. The substantially light-insensitive elongated imaging material used in the present invention may contain one or more surfactants, which may be anionic, non-ionic or cationic surfactants and/or one or more dispersants. Suitable dispersants are natural polymeric substances, synthetic polymeric substances and finely divided powders, e.g. finely divided non-metallic inorganic powders such as silica.

Support

The support of the substantially light-insensitive elongated imaging material used in the present invention may be transparent or translucent and is preferably a thin flexible carrier made transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated thermosensitive element. The support may be dyed or pigmented to provide a transparent coloured background for the image.

Protective Layer

In a preferred embodiment of the present invention a protective layer is provided for the thermosensitive element. In general this protects the thermosensitive element from atmospheric humidity and from surface damage by scratching etc. and prevents direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating. A slipping layer, being the outermost layer, may comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder.

Coating Techniques

The coating of any layer of the substantially light-insensitive elongated imaging material used in the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA. Coating may proceed from aqueous or solvent media with overcoating of dried, partially dried or undried layers.

The following examples and comparative examples illustrate the present invention. The percentages and ratios used in the examples are by weight unless otherwise indicated.

COMPARATIVE EXAMPLES 1 TO 11

Leuco-Dye Based Elongated Imaging Material for Label Production

The label-printing apparatus used for these experiments was a thermal head printer, the thermal head having a nominal resistance of 102.6 ohms and 115 $\mu$m by 142 $\mu$m heating elements. It printed with a line time of 11.5 ms, was powered by six 1.5 volt batteries and had a DC-motor driven drum transport at a process speed of 7.3 mm/s.

BROTHER P-TOUCH TYPE™ M-K231 black on white leuco-dye-based elongated imaging material with an opaque white backing layer was printed with three heating pulses evenly distributed over the line time at the voltages and pulse times given in table 1. The image density $D_{vis}$ and the CIELAB L*, a* and b* values determined in on according to ASTM Norm E308 of the resulting prints are in table 1 below.

TABLE 1

| Comparative example nr | Printing conditions: dot energy [mJ/mm²] | printhead voltage [V] | pulse-length [ms] | Print characteristics: $D_{vis}$ | L* | a* | b* |
|---|---|---|---|---|---|---|---|
| 1 | 49.2 | 3.95 | 1.76 | 1.51 | 20.39 | −0.10 | −5.03 |
| 2 | 55.6 | 4.20 | 1.76 | 1.57 | 18.88 | 0.89 | −5.36 |
| 3 | 56.2 | 3.95 | 2.01 | 1.51 | 20.33 | 0.73 | −5.63 |
| 4 | 63.5 | 4.20 | 2.01 | 1.57 | 18.81 | 0.81 | −5.06 |
| 5 | 64.2 | 3.95 | 2.30 | 1.55 | 19.37 | 0.61 | −5.33 |
| 6 | 68.2 | 4.65 | 1.76 | 1.58 | 18.41 | 0.73 | −4.79 |
| 7 | 72.6 | 4.20 | 2.30 | 1.60 | 17.97 | 0.72 | −4.64 |
| 8 | 77.8 | 4.65 | 2.01 | 1.59 | 18.31 | 0.45 | −4.53 |
| 9 | 83.4 | 4.20 | 2.64 | 1.56 | 19.04 | 0.33 | −4.58 |
| 10 | 89.0 | 4.65 | 2.30 | 1.58 | 18.39 | 0.28 | −4.75 |
| 11 | 95.4 | 4.20 | 3.02 | 1.65 | 16.73 | 0.42 | −3.80 |
| 12 | 102.2 | 4.65 | 2.64 | 1.60 | 17.86 | 0.60 | −4.70 |
| 13 | 109.3 | 4.20 | 3.46 | 1.65 | 16.81 | −0.01 | −3.38 |
| 14 | 116.9 | 4.65 | 3.02 | 1.65 | 16.73 | 0.49 | −4.26 |
| 15 | 134.0 | 4.65 | 3.46 | 1.64 | 16.99 | 0.45 | −4.70 |

These results show a possible marginal increase in $D_{vis}$ with dot energy and no significant dependence of a* and b*-values upon dot energy.

Exposure of Prints to Artificial Sunlight in a Lightfastness Test

The lightfastness of a print produced with the BROTHER P-TOUCH TYPE™ M-K231 leuco dye-based elongated imaging material was evaluated according to DIN 54 024 of August 1983 for the determination of lightfastness of colourings and prints, which is equivalent to the ISO-document 38/1 N 767, pages 59–73, with an Atlas Material Testing Technology BV, D-63558 Gelnhausen, Germany, SUNTEST™ CPS apparatus. In this test the print is exposed to artificial sunlight through a glass filter together with standardized pigmented cloth samples and exposed to different doses of artificial sunlight as determined by the fading of the standardized pigmented cloth samples and expressed as numbers on the International Wool-scale. The background density, $D_{min}$, maximum density, $D_{max}$, and CIELAB a*- and b*-values of the black print with respect to the white background of the material determined after exposure to different International Wool-scale exposures are summarized in table 2.

From table 2 it is evident that at exposures below 6 on the International Wool-scale, there is an appreciable decrease in $D_{max}$ associated with a strong increase in its CIELAB a*-value indicating a shift in the image tone in reflection to the red, which is visible as an increasingly brown image tone, and an increase in $D_{min}$ associated with a strong increase in its CIELAB b*-value, indicating a shift in the image tone of the background to the yellow.

TABLE 2

| | $D_{max}$ | a* | b* | $D_{min}$ | a* | b* |
|---|---|---|---|---|---|---|
| Image characteristics prior to sunlight exposure | 1.602 | 2.21 | −6.78 | 0.083 | −1.72 | 3.31 |
| Image characteristics after an exposure of 2 according to the IWS* | 1.591 | 2.04 | −7.08 | 0.087 | −1.40 | 4.35 |
| Image characteristics after an exposure of 4 according to the IWS* | 1.558 | 2.92 | −7.59 | 0.096 | −0.92 | 10.23 |
| Image characteristics after an exposure of 5 according to the IWS* | 1.040 | 18.73 | −4.33 | 0.144 | 1.00 | 24.29 |
| Image characteristics after an exposure of 5+ according to the IWS* | 1.116 | 16.37 | −2.06 | 0.146 | 1.06 | 24.74 |

*International Wool-scale

INVENTION EXAMPLES 1 TO 11

Preparation of the Thermosensitive Element

The subbed 63 μm thick polyethylene terephthalate support was doctor blade-coated with a composition containing 2-butanone as solvent/dispersing medium so as to obtain thereon, after drying for 1 hour at 50° C., a thermosensitive element with the composition:

| | |
|---|---|
| Silver behenate | 3.379 g/m² |
| PIOLOFORM ™ LL4160, a polyvinyl butyral from WACKER CHEMIE | 3.379 g/m² |
| BAYSILON ™ MA, a silicone oil from BAYER | 0.128 g/m² |
| 7-(ethylcarbonato)benzo[e][1,3]oxazine-2,4-dione, a toning agent | 0.189 g/m² |
| ethyl 3,4-dihydroxybenzoate, a reducing agent | 0.738 g/m² |
| tetrachlorophthalic anhydride | 0.203 g/m² |
| 3'-decanoylamino-1-phenyl-1H-tetrazole-5-thiol* | 0.073 g/m² |
| TINUVIN ™ 320 from CIBA-GEIGY | 0.129 g/m² |
| DESMODUR ™ N100, a hexamethylene diisocyanate from BAYER | 0.348 g/m² |

*

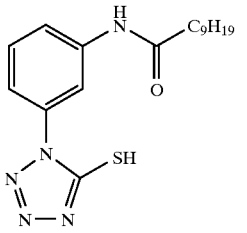

Overcoating of Thermosensitive Element with a Protective Layer

The above-described thermosensitive element was overcoated with a protective layer with the composition:

| | |
|---|---|
| PIOLOFORM ™ LL4160, a polyvinyl butyral from WACKER CHEMIE | 1.539 g/m² |
| BAYSILON ™ MA, a silicone oil from BAYER | 0.006 g/m² |
| MICRODOL ™ SUPER, a talc from Norwegian Talc AS | 0.092 g/m² |
| TINUVIN ™ 320 from CIBA-GEIGY | 0.229 g/m² |
| TEGOGLIDE ™ 410 from Goldschmidt | 0.02 g/m² |

-continued

| | |
|---|---|
| DEXMODUR ™ N100, a hexamethylene diisocyanate from BAYER | 0.154 g/m$^2$ |

Direct Thermal Printing

The direct thermal printer used in these experiments was also a thermal head printer, but had a thermal head with a nominal resistance of 1850 ohms, had 85 $\mu$m by 85 $\mu$m heating elements, printed with a line time of 11.5 ms and the elongated imaging material was transported at a process speed of 7.36 mm/s. The number of heating pulses, printhead voltages and pulse times were completely variable.

The above-described substantially light-insensitive material was printed with a single pulse per line time and at the voltages and pulse times given in table 3 below. The image density $D_{vis}$ and the CIELAB L*, a* and b* values determined in refection according to ASTM Norm E308 of the resulting prints are given in table 3 below.

TABLE 3

| Invention example | Printing conditions | | | Print characteristics | | | |
|---|---|---|---|---|---|---|---|
| | dot energy | printhead voltage | pulse-length | | | | |
| number | [mJ/mm$^2$] | [V] | [ms] | $D_{vis}$ | L* | a* | b* |
| 1 | 37.9 | 11.5 | 3.83 | 0.01 | 99.23 | −0.04 | 0.92 |
| 2 | 41.7 | 11.5 | 4.21 | 0.06 | 94.84 | 0.18 | 2.37 |
| 3 | 45.5 | 11.5 | 4.60 | 0.22 | 81.73 | 0.62 | 6.02 |
| 4 | 49.3 | 11.5 | 4.98 | 0.52 | 61.90 | 0.98 | 9.34 |
| 5 | 53.0 | 11.5 | 5.36 | 0.90 | 41.99 | 1.70 | 11.15 |
| 6 | 56.9 | 11.5 | 5.75 | 1.42 | 22.89 | 2.89 | 9.70 |
| 7 | 60.6 | 11.5 | 6.13 | 1.79 | 13.34 | 2.90 | 4.69 |
| 8 | 64.4 | 11.5 | 6.51 | 1.86 | 11.79 | 1.69 | 0.33 |
| 9 | 68.2 | 11.5 | 6.89 | 1.98 | 9.44 | 1.13 | −1.37 |
| 10 | 72.0 | 11.5 | 7.28 | 1.98 | 9.43 | 0.95 | −1.35 |
| 11 | 75.8 | 11.5 | 7.66 | 1.89 | 11.20 | 0.76 | −2.00 |

The experiments of INVENTION EXAMPLES 1 to 11 show an increase in image density $D_{vis}$ with increasing dot energy. However, the $D_{vis}$ value appears to stabilize and then decrease at the highest dot energies used. The L* value, a measure of the transmission of the layer decreases with increasing dot energy consistent with the increase in $D_{vis}$.

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming more yellow as b* becomes more positive.

The decrease in a* and b* values with increasing dot energy to values near zero for the highest dot energies used thus indicate that the image became more neutral with increasing dot energy.

INVENTION EXAMPLES 12 TO 33

Substantially Light-Insensitive Elongated Imaging Material

The substantially light-insensitive elongated imaging material used in the experiments of INVENTION EXAMPLES 12 to 33 was produced by coating the thermosensitive element overcoated with a protective layer used in INVENTION EXAMPLES 1 to 11 and coating the opposite side of the support to that coated with the thermosensitive element and its protective layer sequentially with a 5.5 g/m$^2$ coating of a white acrylic water-based ink pigmented with titanium dioxide having an optical density of 0.38 and overcoating with a white pressure sensitive water-based dispersion to a coating weight of 26 g/m$^2$, the two layers together having an optical density of 0.65. The second layer was then pressure laminated with the silicone-coated side of 65 g/m$^2$ glassine-based paper coated with a silicone layer, which acts as a release foil.

Printing with a Direct Thermal Label-Printing Apparatus

The label-printing apparatus used for the printing experiments of COMPARATIVE EXAMPLES 1 to 11 was used in the printing experiments of INVENTION EXAMPLES 12 to 33 in which a substantially light-insensitive elongated imaging material produced as described above was printed with three heating pulses evenly distributed over the line time at the voltages and pulse times given in table 4. The image density $D_{vis}$ and the CIELAB L*, a* and b* values determined in refection according to ASTM Norm E308 of the resulting prints are given in table 4 below.

The results are arranged in the order of the dot energies used, independent of the heating power (quadratically dependent upon printhead voltage) and therefore of the temperature attained by the heating element and hence that obtained by the material local thereto. These results are surprising in two ways: in contrast to INVENTION EXAMPLES 1 to 11, the image density decreased with increase dot energy and furthermore despite considerable variations in temperature during the thermal development process due to the different heating powers used in the experiments of INVENTION EXAMPLES 12 to 33, the image density, $D_{vis}$, was found to be mainly dependent upon the dot energy applied, decreasing with increasing dot energy.

TABLE 4

| Invention example | Printing conditions | | | Print characteristics | | | |
|---|---|---|---|---|---|---|---|
| | dot energy | printhead voltage | pulse-length | | | | |
| number | [mJ/mm$^2$] | [V] | [ms] | $D_{vis}$ | L* | a* | b* |
| 12 | 63.7 | 4.20 | 1.76 | 1.93 | 10.39 | −0.04 | 3.87 |
| 13 | 72.3 | 4.20 | 2.01 | 2.15 | 6.34 | 0.81 | −0.98 |
| 14 | 77.8 | 4.65 | 1.76 | 1.97 | 9.54 | 1.70 | −0.14 |
| 15 | 82.7 | 4.20 | 2.30 | 1.95 | 9.98 | 1.02 | −0.62 |
| 16 | 88.8 | 4.65 | 2.01 | 1.77 | 13.88 | 3.45 | 1.26 |
| 17 | 94.9 | 4.20 | 2.64 | 1.74 | 14.46 | 2.98 | 1.27 |
| 18 | 97.4 | 5.20 | 1.76 | 1.65 | 16.64 | 8.89 | 5.00 |
| 19 | 101.7 | 4.65 | 2.30 | 1.60 | 18.00 | 6.05 | 3.53 |
| 20 | 109.0 | 4.20 | 3.02 | 1.64 | 16.90 | 9.95 | 7.09 |
| 21 | 110.8 | 5.20 | 2.01 | 1.52 | 20.17 | 10.38 | 6.89 |
| 22 | 116.4 | 4.65 | 2.64 | 1.49 | 20.97 | 11.56 | 7.56 |
| 23 | 124.9 | 4.20 | 3.46 | 1.58 | 18.52 | 16.04 | 13.45 |
| 24 | 127.4 | 5.20 | 2.30 | 1.50 | 20.59 | 19.18 | 14.52 |
| 25 | 133.5 | 4.65 | 3.02 | 1.50 | 20.71 | 18.20 | 14.52 |
| 26 | 136.6 | 5.20 | 2.47 | 1.41 | 23.42 | 18.00 | 12.76 |
| 27 | 145.7 | 5.20 | 2.64 | 1.25 | 28.30 | 17.29 | 9.70 |
| 28 | 153.1 | 4.65 | 3.46 | 1.36 | 24.83 | 18.14 | 12.07 |
| 29 | 155.5 | 5.20 | 2.82 | 1.23 | 29.00 | 20.77 | 12.14 |
| 30 | 167.2 | 5.20 | 3.02 | 1.13 | 32.84 | 14.02 | 9.14 |
| 31 | 178.2 | 5.20 | 3.23 | 1.00 | 37.69 | 13.86 | 13.27 |

TABLE 4-continued

| Invention example number | Printing conditions: dot energy [mJ/mm²] | printhead voltage [V] | pulse-length [ms] | Print characteristics: $D_{vis}$ | L* | a* | b* |
|---|---|---|---|---|---|---|---|
| 32 | 191.1 | 5.20 | 3.46 | 0.95 | 39.80 | 13.06 | 11.07 |
| 33 | 204.5 | 5.20 | 3.70 | 0.86 | 43.94 | 11.81 | 17.49 |

Furthermore, L*, a* and b* were also found to be dependent upon the dot energy, L* increasing with increasing dot energy, indicating decreasing optical density, and a* and b* increasing with increasing dot energy from values in the region of zero indicating colour neutrality at lower dot energies to increasingly less neutral colour tone with increasing dot energy.

Exposure of Prints to Artificial Sunlight in a Lightfastness Test

A print produced with the organic silver salt-containing elongated imaging material was exposed to artificial sunlight through a glass filter in an Atlas Material Testing Technology BV, SUNTEST™ CPS apparatus according to DIN 54 004. The changes in the background density, $D_{min}$, the maximum density, $D_{max}$, and CIELAB a*- and b*-values with respect to the white background of the material expressed in terms of particular UV-light doses expressed as numbers on the International Woolscale are summarized in table 5.

From table 5 it is evident that even at exposures of 7 on the International Wool-scale, there is no significant change in $D_{max}$ or its CIELAB a*- and b*-values, i.e. there is no fading or changes in the image tone, and the increase in $D_{min}$ is appreciably lower and the increase in its CIELAB b*-value much less pronounced than in the case of the BROTHER P-TOUCH TYPE™ M-K231 leuco dye-based elongated imaging material.

TABLE 5

| | $D_{max}$ | a* | b* | $D_{min}$ | a* | b* |
|---|---|---|---|---|---|---|
| Image characteristics prior to sunlight exposure | 1.805 | 12.87 | 4.42 | 0.109 | −0.90 | 9.67 |
| Image characteristics after an exposure of 4 according to the IWS* | 1.862 | 11.26 | 2.88 | 0.139 | −0.51 | 10.34 |
| Image characteristics after an exposure of 7 according to the IWS* | 1.845 | 11.92 | 2.61 | 0.167 | 0.85 | 16.26 |

*International Wool-scale

This demonstrates that using elongated imaging materials based upon organic silver salts have the advantages over the conventionally used leuco dye-based elongated imaging materials of no fading or changes in the image tone in $D_{max}$ and reduced $D_{min}$ increase and background discoloration upon exposure to artificial sunlight.

INVENTION EXAMPLES 34 TO 51

Influence of Number of Pulses and Heating Power at Constant Dot Energy

The dot energies for INVENTION EXAMPLES 14 & 15 were approximately 80 mJ/mm², those for INVENTION EXAMPLES 20 & 21 were approximately 110 mJ/mm², those for 23 & 24 were approximately 126 mJ/mm² and those for INVENTION EXAMPLES 28 & 29 were approximately 154 mJ/mm². These INVENTION EXAMPLES show that the dot energy is the principal determinant of the image density, $D_{vis}$. INVENTION EXAMPLES 34 to 51 were carried out on the same material as that used for INVENTION EXAMPLES 1 to 11 at a dot energy per pixel of approximately 74 mJ/mm² with the direct thermal printer also used for INVENTION EXAMPLES 1 to 11. In these experiments the number of pulses (evenly distributed over the line time of 11.5 ms), the pulse-length and the heating power was varied with a single pulse being used inn INVENTION EXAMPLES 34 to 39, two pulses being used in INVENTION EXAMPLES 40 to 45 and three pulses being used in INVENTION EXAMPLES 46 to 51. The image density attained in INVENTION EXAMPLES 34 to 51 approximately corresponds to the maximum image density attained in the experiments of INVENTION EXAMPLES 1 to 11.

INVENTION EXAMPLES 34 to 39 were carried out by providing the heating energy in a single equi-energetic pulse at different heating powers and hence pulse-lengths. The $D_{vis}$, L*, a* and b* values obtained under the different printing conditions are summarized in table 6.

TABLE 6

| Invention example number | Printing with one heating pulse/line time: heating power [W/mm²] | printhead voltage [V] | pulse-length [ms] | Print characteristics: $D_{vis}$ | L* | a* | b* |
|---|---|---|---|---|---|---|---|
| 34 | 24.2 | 18.0 | 3.06 | 2.32 | 4.29 | 0.70 | −0.26 |
| 35 | 21.6 | 17.0 | 3.45 | 2.29 | 4.58 | 0.79 | −0.28 |
| 36 | 18.4 | 15.7 | 4.00 | 2.28 | 4.57 | 1.26 | 0.08 |
| 37 | 14.7 | 14.0 | 5.00 | 2.23 | 5.22 | 0.84 | −0.15 |
| 38 | 12.9 | 13.1 | 5.75 | 2.24 | 4.99 | 1.32 | 0.31 |
| 39 | 9.83 | 11.5 | 7.66 | 2.21 | 5.58 | 0.61 | −0.88 |

Little variation in print characteristics was observed. However, if the heating energy was provided in two heating pulses evenly distributed over the line time of 11.5 ms (INVENTION EXAMPLES 40 to 45), the $D_{vis}$, L*, a* and b* values shown in table 7 were obtained.

TABLE 7

| Invention example number | Printing with two heating pulses per line time: heating power [W/mm²] | printhead voltage [V] | pulse-length [ms] | Print characteristics: $D_{vis}$ | L* | a* | b* |
|---|---|---|---|---|---|---|---|
| 40 | 24.2 | 18.0 | 1.53 | 2.13 | 5.95 | 5.43 | 3.03 |
| 41 | 21.6 | 17.0 | 1.73 | 1.99 | 7.77 | 9.62 | 5.02 |
| 42 | 18.4 | 15.7 | 2.00 | 2.10 | 6.32 | 5.81 | 2.87 |
| 43 | 14.7 | 14.0 | 2.50 | 2.24 | 4.88 | 2.77 | 1.18 |
| 44 | 12.9 | 13.1 | 2.88 | 2.32 | 4.25 | 0.84 | −0.03 |
| 45 | 9.83 | 11.5 | 3.83 | 2.39 | 3.58 | 0.59 | −0.02 |

In printing with two heating pulses per line time a significant increase in image density $D_{vis}$ was observed upon reducing the heating power and concomitantly increasing the pulse-length. In addition a considerable improvement in the image tone neutrality was observed, as seen by the decrease in a*- and b*-values to values close to zero, upon reducing the heating power and concomitantly increasing the pulse-length.

In INVENTION EXAMPLES 46 to 51, the heating energy was provided in three heating pulses evenly distributed over the line time of 11.5 ms and the $D_{vis}$, L*, a* and b* values shown in table 8 were obtained. $D_{vis}$, L*, a* and b* values shown in table 8 varied with heating power in the same way as for two pulses, but the variation was less marked.

TABLE 8

| Invention example | Printing with two heating pulses per line time: heating power | printhead voltage | pulse-length | Print characteristics | | | |
|---|---|---|---|---|---|---|---|
| number | [W/mm²] | [V] | [ms] | $D_{vis}$ | L* | a* | b* |
| 46 | 24.2 | 18.0 | 1.02 | 2.23 | 4.94 | 2.42 | 1.71 |
| 47 | 21.6 | 17.0 | 1.15 | 2.15 | 5.72 | 4.25 | 2.69 |
| 48 | 18.4 | 15.7 | 1.33 | 2.28 | 4.46 | 1.95 | 1.21 |
| 49 | 14.7 | 14.0 | 1.66 | 2.26 | 4.77 | 1.32 | 0.31 |
| 50 | 12.9 | 13.1 | 1.92 | 2.37 | 3.75 | 0.71 | 0.07 |
| 51 | 9.83 | 11.5 | 2.55 | 2.37 | 3.83 | 0.42 | −0.39 |

In conclusion for a given dot energy in the case of multiple pulses it is beneficial for image density and image tone to use the lowest heating power possible and thereby correspondingly longer heating pulses. This is particularly beneficial when two pulses are used per line time. In the case of a single pulse, which for technical reasons is less favourable, due to greater drain on a DC-power source and greater thermal head temperature fluctuation during printer resulting in less reliable transport of the substantially light-sensitive elongated imaging material and greater abrasion of the thermal head, is less interesting, there is little dependence of image density and image tone upon heating power.

Having described in detail preferred embodiments of the current invention, it will now be apparent to those skilled in the art that numerous modifications can be made therein without departing from the scope of the invention as defined in the following claims.

What is claimed is:

1. A label-printing process for obtaining a desired optical density and a desired colour tone with a substantially light-insensitive elongated imaging material, said label-printing process comprising:

selecting an elongated imaging material, said selected elongated imaging material having a support and a thermosensitive element;

supplying image data to a processing unit of a thermal printer including a printhead having energizable heating elements arranged in a column C;

converting said image data which are not zero into at least one activation pulse per pixel to be printed;

energising said heating elements printing-line by printing-line adjacent to said selected elongated imaging material thereby producing an image;

transporting said imaging material past and adjacent to said printhead in a transport direction with a transport system;

forming an image dot with a heat energy of 50 to 200 mJ/mm² of heating element surface area;

wherein said thermosensitive element contains a substantially light-insensitive organic silver salt, a reducing agent therefor in thermal working relationship therewith and a binder; and said thermosensitive element excludes a colourless or light coloured dye precursor and also excludes an encapsulated organic silver salt in a heat-responsive microcapsule.

2. Label-printing process according to claim 1, comprising the further step of selecting the supply-voltage which determines the heating power, the column-time and/or the column-duty-cycle ▽ for obtaining said optical density and said colour tone with said selected elongated imaging material.

3. Label-printing process according to claim 2, wherein in said energising of said heating elements said heating power is as low as possible and said column-duty-cycle ▽ is as high as possible in achieving a particular heat energy for the formation of said image dot.

4. Label-printing process according to claim 1, wherein said energisable heating elements are grouped in at least two sections S of energisable heating elements.

5. Label-printing process according to claim 1, wherein said printhead consists of more than one column of energisable heating elements.

6. Label-printing process according claim 1, wherein said energising of the heating elements printing-line by printing-line is carried out section by section.

7. Label-printing process according claim 1, wherein a configuration memory contains characteristics of at least one elongated imaging material relating to a range of available column-times, to a range of available transportation speeds, to a range of available voltages.

8. Label-printing process according to claim 7, wherein said characteristics of said at least one elongated imaging material include the characteristics of an elongated imaging material requiring a maximal available voltage, to a minimal available column-duty cycle ▽, and to a predefined transportation speed.

9. Label-printing process according to claim 1, wherein the heating power per heating element in said energization of heating elements is in accordance with $P \leqq P_{max} = 3.3\ W/mm^2 + (9.5\ W/mm^2 \times \nabla)$, where $P_{max}$ is the maximal value over all said heating elements of the time averaged power density P (expressed in W/mm²) dissipated by said heating element during said column-line-time.

10. Label-printing process according to claim 7, wherein said selection of the supply-voltage, the column-time and/or the column-duty-cycle ▽ for obtaining said optical density and said colour tone with said selected elongated imaging material includes:

generating a signal indicative of said elongated imaging material;

retrieving from said configuration memory values for the supply-voltage, for the column-time and for the column-duty-cycle ▽ corresponding to said optical density and said colour tone for said selected elongated imaging material.

11. An apparatus for the printing of labels comprising:

a selector of a substantially light-insensitive elongated imaging material, said elongated imaging material having a support and a thermosensitive element;

a source of image data to a processing unit of a thermal printer including a printhead having energizable heating elements arranged in a column C;

a converter of said image data which are not zero into at least one activation pulse per pixel to be printed;

an energizer of said heating elements printing-line by printing-line adjacent to said selected elongated imaging material thereby producing an image;

a transport system to transport said imaging material past and adjacent to said printhead in a transport direction with said transport system;

an image dot former with a heat energy of 50 to 200 mJ/mm² of heating element surface area;

wherein said thermosensitive element contains a substantially light-insensitive organic silver salt, a reducing agent therefor in thermal working relationship therewith and a binder; and said thermosensitive element excludes a colourless or light coloured dye precursor and also excludes an encapsulated organic silver salt in a heat-responsive microcapsule.

* * * * *

UNITED STATES PATENT AND TRADEMARK OFFICE

CERTIFICATE OF CORRECTION

PATENT NO. : 6,244,766 B1
DATED : June 12, 2001
INVENTOR(S) : Dunn et al.

It is certified that error appears in the above-identified patent and that said Letters Patent is hereby corrected as shown below:

Column 14,
Line 55, "H" should read -- "H" --
Line 57, "C" should read -- "C" --
Line 57, "D" should read -- "D" --

Column 21,
Line 2, "DEXMODUR" should read -- DESMODUR --.

Column 25,
Line 6, "two" should read -- three --.

Signed and Sealed this

Twenty-sixth Day of February, 2002

*Attest:*

*Attesting Officer*

JAMES E. ROGAN
*Director of the United States Patent and Trademark Office*